US005091292A

United States Patent [19]

Fujimoto et al.

[11] Patent Number: 5,091,292

[45] Date of Patent: Feb. 25, 1992

[54] METHOD FOR PROCESSING SILVER HALIDE COLOR PHOTOGRAPHIC MATERIAL

[75] Inventors: Hiroshi Fujimoto; Kiyoshi Morimoto; Takatoshi Ishikawa, all of Minami-ashigara, Japan

[73] Assignee: Fuji Photo Film Co., Ltd, Kanagawa, Japan

[21] Appl. No.: 561,550

[22] Filed: Aug. 1, 1990

[30] Foreign Application Priority Data

Aug. 1, 1989 [JP] Japan ..... 1-199647

[51] Int. Cl.[5] ..... G03C 7/30

[52] U.S. Cl. ..... 430/467; 430/484; 430/485; 430/493

[58] Field of Search ..... 430/464, 467, 484, 485, 430/490, 493, 398, 399, 400

[56] References Cited

U.S. PATENT DOCUMENTS

| | | | |
|---|---|---|---|
| 4,232,112 | 11/1980 | Kuse | 430/393 |
| 4,565,776 | 1/1986 | Kim et al. | 430/467 |
| 4,797,349 | 1/1989 | Takahashi et al. | 430/372 |
| 4,801,516 | 1/1989 | Ishikawa et al. | 430/380 |
| 4,892,804 | 1/1990 | Vincent et al. | 430/380 |
| 4,965,175 | 10/1990 | Fujimoto et al. | 430/375 |

FOREIGN PATENT DOCUMENTS

| | | | |
|---|---|---|---|
| 0087370 | 8/1933 | European Pat. Off. . | |
| 0269740 | 6/1988 | European Pat. Off. . | |
| 135464 | 8/1984 | Japan | 430/399 |
| 63-5341 | 1/1986 | Japan . | |
| 63-4234 | 6/1986 | Japan . | |
| 242938 | 10/1987 | Japan | 430/490 |
| 48549 | 3/1988 | Japan | 430/490 |
| 179351 | 7/1988 | Japan | 430/490 |
| 2139370 | 3/1983 | United Kingdom . | |

OTHER PUBLICATIONS

Patent Abstracts of Japan, vol. 12, No. 114, (P-668)-(2961) Apr. 12, 1988, & JP-A-62 242938.

*Primary Examiner*—Hoa Van Le

*Attorney, Agent, or Firm*—Sughrue, Mion, Zinn, Macpeak & Seas

[57] ABSTRACT

There is disclosed a method for processing a silver halide color photographic material with a color developer and thereafter desilvering, wherein the silver halide color photographic material has a thickness of dried coatings of 15 μm or less and the color developer comprises an anionic surface-active agent and a hydroxylamine compound. According to the disclosure staining in the unexposed part of the photographic material can be remarkably improved even in a continuous processing.

12 Claims, No Drawings

METHOD FOR PROCESSING SILVER HALIDE COLOR PHOTOGRAPHIC MATERIAL

FIELD OF THE INVENTION

The present invention relates to a method for processing silver halide color photographic materials, and in particular to a method for processing a silver halide color photographic material wherein staining in the unexposed part is remarkably improved even when the silver halide color photographic material is processed continuously.

BACKGROUND OF THE INVENTION

Color developers containing an aromatic primary amine color-developing agent have been widely used conventionally for a long time for the formation of color images, and at present they play a major role in the method for forming images of color photographs. However, the above color developers have the problem that they are very readily oxidized by air or a metal, and it is well known that when a color image is formed by using an oxidized developer, desired photographic performance cannot be obtained because fogging increases or the sensitivity or gradation changes.

In particular, as the time of the processing step is shortened, as is common today, the change of photographic performance at the time of continuous processing is apt to become large, and in some cases, a serious problem leading to color stains arises. In particular, when the desilvering step or the washing step is shortened, or when the processing amount per unit of time is small, the above problem is apt to arise.

As causes leading to color stains under these circumstances, there are many considerations. For instance:

A: The color developer deteriorates with time, the photographic performance changes, the oxidized product of the developing agent adheres to the photographic material, and therefore the rinsing becomes insufficient, bringing about color stains.

B: The color-developing agent is carried in the bleaching solution or the bleach-fix solution and is oxidized therein, causing fogging or stains.

C: Dissolved-out materials from the photographic material accumulate in the color developer and adhere to the photographic material, causing color stains.

D: The washing out of the dyes and sensitizing dyes contained in the photographic material is not sufficient, thereby the photographic material remains colored.

E: The bleach-fix solution or the washing water or the stabilizing solution placed after the bleach-fix solution deteriorates with time, causing color stains.

In order to solve problem A in particular, it is necessary to improve the stability of the color developer, and many studies have been made.

For instance, in order to improve the stability of color developers, various preservatives and chelating agents have been studied. For example, as preservatives can be mentioned aromatic polyhydroxy compounds described, for example, in JP-A ("JP-A" means unexamined published Japanese patent application) Nos. 49828/1987, 160142/1984, and 47038/1981 and U.S. Pat. No. 3,746,544, hydroxycarbonyl compounds described in U.S. Pat. No. 3,615,503 and British Patent No. 1,306,176, α-aminocarbonyl compounds described in JP-A Nos. 143020/1977 and 89425/1978, alkanolamines described in JP-A No. 3532/1989, and metal salts described in JP-A Nos. 44148/1982 and 53749/1982. As chelating agents can be mentioned aminopolycarboxylic acids described in JP-B ("JP-B" means unexamined Japanese patent publication) Nos. 030496/1973 and 30232/1969, organic phosphonic acids described in JP-A No. 97347/1981 and JP-B 39359/1981 and West German Patent No. 2227639, phosphonocarboxylic acids described, for example, in JP-A Nos. 102726/1977, 42730/1978, 121127/1979, 126241/1980, and 65956/1980, compounds described, for example, in JP-A Nos. 195845/1983 and 203440/1983 and JP-B No. 40900/1978, and organophosphonic acid chelating agents described in Research Disclosure Nos. 18837 and 17048.

However, even if these preservation-improving techniques are employed, coloring and deterioration of color developers cannot be completely prevented. Further, although sulfite ions are effective in preventing developers from coloring, they cannot be used in a large amount for such as black-and-white developers, because sulfite ions harmfully affect the color formation or have a solvent effect on silver halides. Additionally, recently it is preferred that sulfite ions not be used in view of the improvement of color formation, and therefore coloring of color developers is becoming a further serious problem.

Although hydroxylamine compounds are described as preservatives (antioxidantas) for color developers, for example, in JP-A Nos. 106655/1988 and 5341/1988 and WO 87/04534, for rapid processing or for a small amount of processing, as in the present invention, they are not adequate to prevent color stains from occurring.

To prevent color stains due to deterioration of color developers over time as stated above, it is necessary to prevent the color developer from being oxidized, and also it is required that adhesion, mainly of the oxidized product (contaminant) of the developing agent in the color developer, is reduced and that the oxidized product of the developing agent is washed out in the subsequent step, to lessen color staining.

BRIEF SUMMARY OF THE INVENTION

Therefore the object of the present invention is to provide a method for forming a color image for rapid processing or for a small amount of processing wherein color stains of the processed color photographic material, particularly due to the oxidized product of the developing agent, are remarkably reduced.

Other and further objects, features and advantages of the invention will appear more evident from the following description.

DETAILED DESCRIPTION OF THE INVENTION

It has been found that the above object can be attained by the method described below.

The present invention provides a method for processing a silver halide color photographic material, characterized in that a silver halide color photographic material, the thickness of dried coatings of which is 15 μm or less, is processed with a color developer containing at least one of anionic surface-active agents represented by the following formula (W-I):

R—X Formula (W-I)

wherein R represents a substituted or unsubstituted alkyl, cycloalkyl, alkenyl, alkynyl, aryl, or heterocyclic group having 8 or more carbon atoms, and X represents —COOM, —$SO_3$, —$OSO_3M$, —$OP(OM)_2$, or

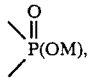

in which M represents a hydrogen atom, lithium, potassium sodium, or ammonium, and at least one of compounds represented by the following formula (I):

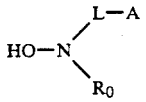

wherein L represents an alkylene group which may be substituted, A represents a carboxyl group, a sulfo group, a phosphono group, a phosphinic acid residue, a hydroxyl group, an amino group which may be substituted by an alkyl group, or an ammonio group which may be substituted by an alkyl group, and $R_0$ represents a hydrogen atom or an alkyl group which may be substituted, and thereafter is desilvered. It is preferable that the silver halide color photographic material is desilvered immediately after the color development processing.

It has been unexpected that color stains likely attributed to the oxidized product of a developing agent can be considerably reduced both by using a combination of an anionic surface-active agent represented by formula [W-I] with a compound (soluble in water) of formula (I), and by making thinner the thickness of the hydrophilic colloid layers of the color photographic material.

Herein, although the mechanism of the action has not been well clarified, such an effect has not been attained by the use of cationic surface-active agents or nonionic surface-active agents.

Formula [W-I] will be described in detail below.

The substituents of R, in the case of alkyl, cycloalkyl, alkenyl, and alkynyl groups, are —$OR^1$, —$SR^1$,

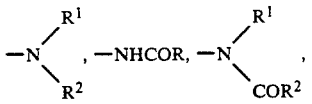

—$COR^1$, —$COOR^1$, —$NHSO_2R^1$, —$CONHR^1$, —$SO_2NHR^1$, halogen (F, Cl, and Br), —CN, and the above-mentioned X, in which $R^1$ and $R^2$ represent an alkyl, cycloalkyl, alkenyl, aryl, or heterocyclic group as defined above and having 1 or more carbon atoms. The substituents on the aryl and heterocyclic groups include the above substituents as well as alkyl and aryl groups.

Preferable compounds of R-X represented by formula [W-I] are those wherein R represents an alkyl, alkenyl, or aryl group having 8 to 30 carbon atoms (for one constitutional unit in the case of a polymer).

Specific examples of the compound represented by formula (W-I) are given below, but the invention is not limited to them.

$C_{12}H_{25}COONa$ W-1

-continued $C_{18}H_{37}COONa$ W-2

$C_{11}H_{23}CON(CH_3)CH_2COONa$ W-3

$C_{11}H_{23}CON(CH_3)CH_2CH_2COONa$ W-4

$C_{11}H_{23}CONH(CH_2CH_2COOH)CHCOOH$ W-5

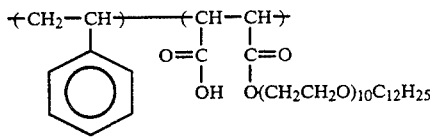

Average molecular weight: 2,000 W-6

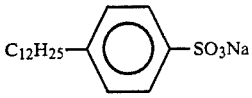

W-7

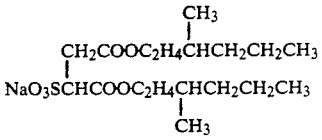

W-8

$C_{11}H_{25}CH{=}CHCH_2SO_3Na$ W-9

$C_{11}H_{25}CH(OH)CH_2CH_2SO_3Na$ W-10

$C_{12}H_{25}O(CH_2)_4SO_3Na$ W-11

$C_{17}H_{35}CON(CH_3)CH_2CH_2SO_3Na$ W-12

W-13

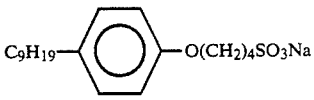

W-14

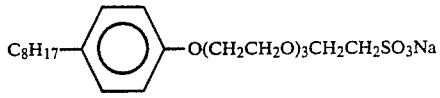

W-15

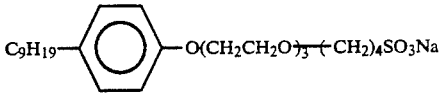

W-16

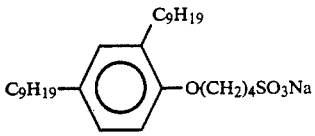

W-17

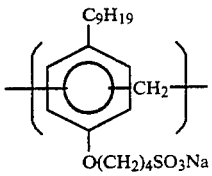

-continued

W-18

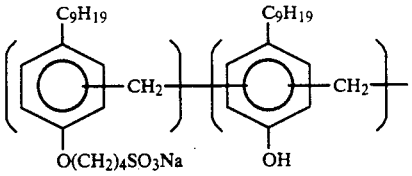

W-19

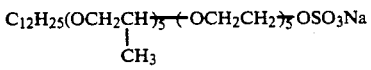

W-20

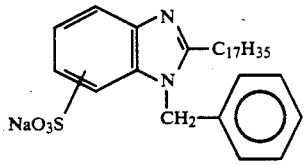

W-21

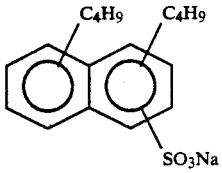

W-22

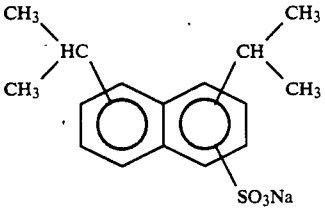

W-23

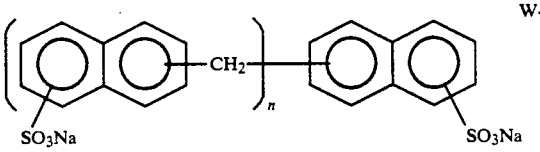

W-24

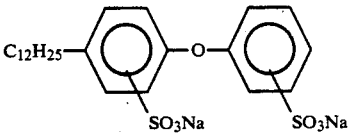

W-25

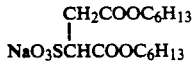

W-26

$C_{12}H_{25}OSO_3Na$

W-27

$C_{18}H_{37}OSO_3Na$

W-28

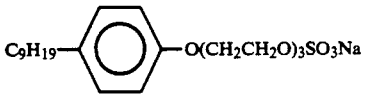

W-29

$NaO_3SO(C_3H_6O)_7SO_3Na$

W-30

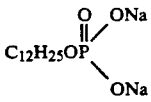

-continued

W-31

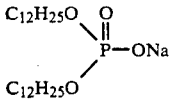

Preferably the content of the above compound in the color developer is 0.01 to 10 g/l, more preferably 0.05 to 3 g/l.

To incorporate the above compound in the color developer, the compound may be added directly to the color developer, or it may be contained in the photographic material and allowed to dissolve out into the developer. In the latter case, although it is preferable that the compound is used as a dispersant of a hydrophobic material (e.g., color couplers), the compound may be added in portions when coating is effected after dispersing.

The color developer of the present invention will now be described in detail.

The color developer of the present invention contains a compound of formula (I).

In formula (I), L represents a straight-chain or branched-chain alkylene group which may be substituted having 1 to 10 carbon atoms, preferably 1 to 5 carbon atoms. Methylene, ethylene, trimethylene, and propylene can be mentioned as preferable specific examples. As the substituents of the alkylene group, a carboxyl group, a sulfo group, a phosphono group, a phosphinic acid residue, a hydroxyl group, an ammonio group which may be substituted by an alkyl group (the alkyl preferably having 1 to 5 carbon atoms) can be mentioned. Of these, a carboxyl group, a sulfo group, a phosphono group, and a hydroxyl group can be mentioned as preferable examples. A represents a carboxyl group, a sulfo group, a phosphono group, a phosphinic acid residue, a hydroxyl group, an amino group which may be substituted by an alkyl group (the alkyl preferably having 1 to 5 carbon atoms), an ammonio group which may be substituted by an alkyl group (the alkyl preferably having 1 to 5 carbon atoms). Preferable examples of A include a carboxyl group, a sulfo group, a hydroxyl group, or a phosphono group. As preferable examples of —L—A, a carboxymethyl group, a carboxyethyl group, a carboxypropyl group, a sulfoethyl group, a sulfopropyl group, a sulfobutyl group, a phosphonomethyl group, a phosphonoethyl group, and a hydroxyethyl group can be mentioned. Particularly preferable examples are a carboxymethyl group, a carboxyethyl group, a sulfoethyl group, a sulfopropyl group, a phosphonomethyl group, and a phosphonoethyl group. $R_0$ represents a hydrogen atom or a straight-chain or branched-chain alkyl group which may be substituted having 1 to 10 carbon atoms, preferably 1 to 5 carbon atoms. The substituent includes a carboxyl group, a sulfo group, a phosphono group, a phosphinic acid residue, a hydroxyl group, an amino group which may be substituted by an alkyl group, and an ammonio group which may be substituted by an alkyl group. Two or more such substituents may be present. Preferable examples of $R_0$ are a hydrogen atom, a carboxymethyl group, a carboxyethyl group, a carboxypropyl group, a sulfoethyl group, a sulfopropyl group, a sulfobutyl group, a phosphonomethyl group, a phosphonoethyl group, and a hydroxyethyl group, with particular preference given to a hydrogen atom, a carboxymethyl group, a carboxyethyl group, a sulfoethyl group, a sulfopropyl group, a phosphonomethyl group and a phosphonoethyl group. L and $R_0$ may bond together to form a ring.
Specific examples of the compound represented by formula (I) are given below, but the invention is not limited to them.
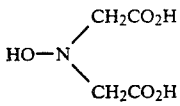
(1)
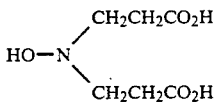
(2)
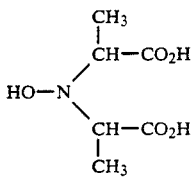
(3)
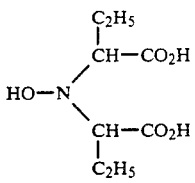
(4)
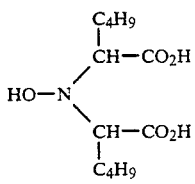
(5)
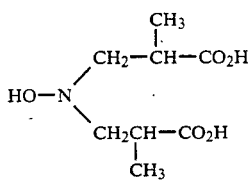
(6)
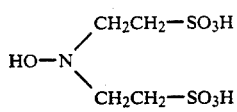
(7)
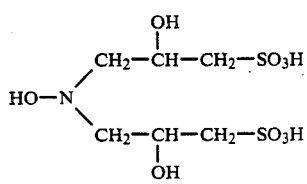
(8)
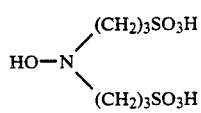
(9)
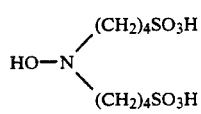
(10)
-continued
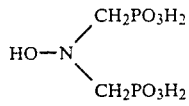
(11)
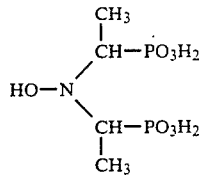
(12)
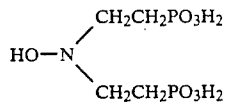
(13)
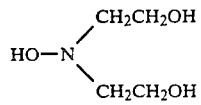
(14)
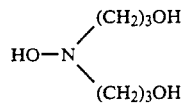
(15)
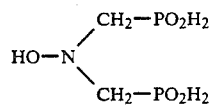
(16)
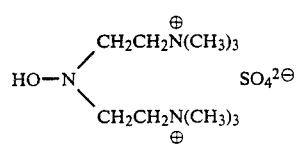
(17)
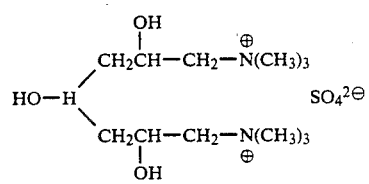
(18)
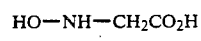
(19)
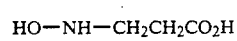
(20)
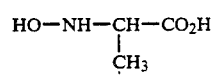
(21)
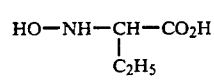
(22)
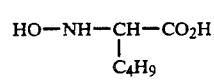
(23)
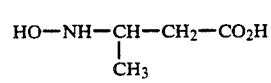
(24)
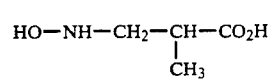
(25)
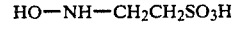
(26)

-continued $HO-NH-CH_2CH(OH)CH_2SO_3H$ (27)

$HO-NH-(CH_2)_3SO_3H$ (28)

$HO-NH-(CH_2)_4SO_3H$ (29)

$HO-NH-CH_2PO_3H_2$ (30)

$HO-NH-CH(CH_3)-PO_3H_2$ (31)

$HO-NH-CH_2CH_2PO_3H_2$ (32)

$HO-NH-CH_2CH_2OH$ (33)

$HO-NH-(CH_2)_3OH$ (34)

$HO-NH-CH_2-PO_2H_2$ (35)

$HO-NH-CH_2CH_2\overset{\oplus}{N}(CH_3)_3$ (36)

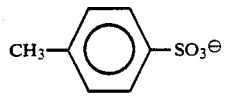

$HO-NH-CH_2CH(OH)CH_2\overset{\oplus}{N}(CH_3)_3$ (37)

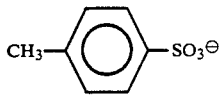

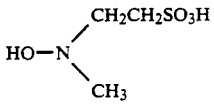

(38)

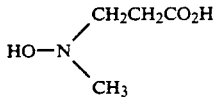

(39)

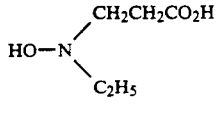

(40)

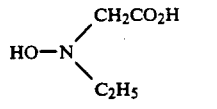

(41)

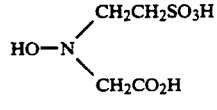

(42)

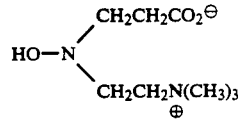

(43)

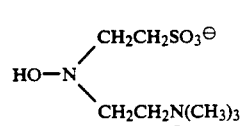

(44)

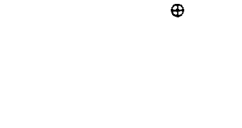

-continued

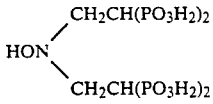

(45)

$HONHCH_2CH(PO_3H_2)_2$ (46)

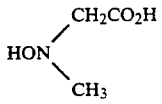

(47)

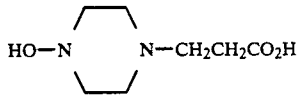

(48)

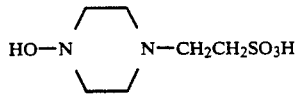

(49)

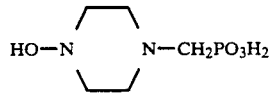

(50)

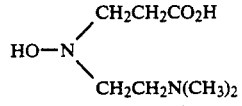

(51)

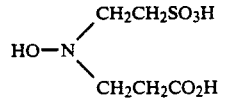

(52)

The compound represented by formula (I) can be synthesized by subjecting a commercially available hydroxylamine to an alkylation reaction (including a nucleophilic substitution reaction, an addition reaction, and a Mannich reaction). Although the compounds represented by formula (I) can be synthesized in accordance with the synthesis method disclosed, for example, in West German Patent Publication No. 1159634 or *Inorganica Chimica Acta,* 93, (1984) 101-108, specific synthesis methods for them are described below.

SYNTHESIS EXAMPLES

SYNTHESIS OF EXEMPLIFIED COMPOUND (7)

11.5 g of sodium hydroxide and 96 g of sodium chloroethanesulfonate were added to 200 ml of an aqueous solution containing 20 g of hydroxylamine hydrochloride, and 40 ml of an aqueous solution containing 23 g of sodium hydroxide was added thereto gradually over 1 hour with the temperature being kept at 60° C. Further, while keeping the temperature at 60° C. for 3 hours, the reaction liquid was condensed under reduced pressure, then 200 ml of concentrated hydrochloric acid was added and the mixture was heated to 50° C. The insolubles were filtered off and 500 ml of methanol was added to the filtrate, to obtain crystals of the monosodium salt of the desired product (Exemplified Compound (7)) in an amount of 41 g (yield:53%).

SYNTHESIS OF EXEMPLIFIED COMPOUND (11)

32.6 g of formalin was added to a hydrochloric acid solution containing 7.2 g of hydroxylamine hydrochloride and 18.0 g of phosphorous acid, and the mixture was heated under reflux for 2 hours. The resulting crystals were recrystallized using water and methanol, to obtain 9.2 g of Exemplified Compound (11) (yield:42%).

The amount of these compounds to be added is preferably 0.1 to 50 g, more preferably 1 to 10 g, per l of the color developer.

In addition to the compound of formula (I), various preservatives can also be added to an extent that would not damage the effect of the present invention. For example, hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds, and condensed cyclic amines are effective organic preservatives. These are disclosed, for example, in JP-A Nos. 4235/1988, 30845/1988, 21647/1988, 44655/1988, 53551/1988, 43140/1988, 56654/1988, 58346/1988, 43138/1988, 146041/1988, 170642/1988, 44657/1998, and 44656/1988, U.S. Pat. Nos. 3,615,503, and 2,494,903, JP-A No. 143020/1977, and JP-B 30496/1973.

It is preferable that an alkanolamine (e.g., triethanolamine and diethanolamine) is additionally used.

The color developer used in the present invention contains an aromatic primary amine color-developing agent. As the color-developing agent conventional ones can be used. Preferred examples of aromatic primary amine color-developing agents are p-phenylenediamine derivatives. Representative examples are given below, but they are not meant to limit the present invention:

D-1: N,N-diethyl-p-phenylenediamine

D-2: 4-[N-ethyl-N-(β-hydroxyethyl)amino]aniline

D-3: 2-methyl-4-[N-ethyl-N-(β-hydroxyethyl-)amino]aniline

D-4: 4-amino-3-methyl-N-ethyl-N-[β-(methanesulfonamido)ethyl]-aniline

These p-phenylenediamine derivatives may be in the form of salts such as sulfates, hydrochloride, sulfites, and p-toluenesulfonates. The amount of aromatic primary amine developing agent to be used is preferably about 0.1 g to about 20 g, more preferably about 0.5 g to about 10 g, per liter of developer.

Preferably the pH of the color developer of the present invention is in the range of 9 to 12, more preferably 9 to 11.0, and other known compounds that are components of a conventional developing solution can be contained.

In order to keep the above pH, it is preferable to use various buffers. As buffers, there are included sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The amount of buffer to be added to the color developer is preferably 0.1 mol/l or more, and particularly preferably 0.1 to 0.4 mol./l.

In addition to the color developer can be added various chelating agents to prevent calcium or magnesium from precipitating or to improve the stability of the color developer.

Specific examples are shown below, but the present invention is not limited to them: nitrilotriacetic acid, diethyleneditriaminepentaacetic acid, ethylenediaminetetraacetic acid, triethylenetetraminehexaacetic acid, N,N,N-trimethylenephosphonic acid, ethylenediamine-N,N,N',N'-tetramethylenesulfonic acid, 1,3-diamino-2-propanoltetraacetic acid, transcyclohexanediaminetetraacetic acid, nitrilotripropionic acid, 1,2-diaminopropanetetraacetic acid, hydroxyethyliminodiacetic acid, glycol ether diaminetetraacetic acid, hydroxyethylenediaminetriacetic acid, ethylenediamineorthohydroxyphenyltetraacetic acid, 2-phosphonobutane-1,2,4-tricarboxylic acid, 1- hydroxyethylidene-1,1-diphosphonic acid, N,N,-bis(2-hydroxybenzyl)ethylenediamine-N,N'-diacetic acid, catechol-3,4,6-trisulfonic acid, catechol-3,5-disulfonic acid, 5-sulfosalicylic acid, and 4-sulfosalicylic acid.

If necessary, two or more of these chelating agents may be used together.

With respect to the amount of these chelating agents to be added to the color developer, it is good if the amount is enough to sequester metal ions in the color developer. The amount, for example, is on the order of 0.1 g to 10 g per liter.

If necessary, any development accelerator can be added to the color developer.

As development accelerators, the following can be added as desired: thioether compounds disclosed, for example, in JP-B Nos. 16088/1962, 5987/1962, 7826/1962, 12380/1969, and 9019/1970, and U.S. Pat. No. 3,813,247; p-phenylenediamine compounds disclosed in JP-A Nos. 49829/1977 and 15554/1975; quaternary ammonium salts disclosed, for example, in JP-A No. 137726/1975, JP-B No. 30074/1969, and JP-A Nos. 156826/1981 and 43429/1977; p-aminophenols disclosed, for example, in U.S. Pat. Nos. 2,610,122 and 4,119,462; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, mesoionic type compounds, ionic type compounds, and imidazoles.

It is preferable that the color developer of the present invention is substantially free from benzyl alcohol. Herein the term "substantially free from" means that the amount of benzyl alcohol is 2.0 ml or below per liter of the developer, or preferably benzyl alcohol is not contained in the developer at all, because of being the fluctuation of photographic characteristics little.

In the present invention, if necessary, any antifoggant can be added in addition to chloride ion and bromide ion. As antifoggants, use can be made of alkali metal halides, such as potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, indazole, hydroxyazaindolizine, and adenine.

It is preferable that the color developer used in the present invention contains a brightening agent. As the brightening agent, 4,4'-diamino-2,2'-disulfostilbene compounds are preferable, which will be added in an amount of 0 to 10 g/l, preferably 0.1 to 6 g/l.

If required, various surface-active agents, such as alkylsulfonic acids, arylphosphonic acids, aliphatic carboxylic acids, and aromatic carboxylic acids may be added.

The processing temperature with the color developer of the present invention is 20° to 50° C., preferably 30° to 40° C. The processing time is 20 sec. to 5 min., preferably 30 sec. to 2 min.

In the present invention desilvering is effected after color development. The desilvering step generally consists of a bleaching step and a fixing step, and particularly preferably the bleaching step and the fixing step are carried out simultaneously.

Further, the bleaching solution or the bleach-fixing solution used in the present invention can contain rehalogenation agents, such as bromides (e.g., potassium bromide, sodium bromide, and ammonium bromide), chlorides (e.g., potassium chloride, sodium chloride, and ammonium chloride), or iodides (e.g., ammonium iodide). If necessary the bleaching solution or the bleach-fixing solution can contain, for example, one or more inorganic acids and organic acids or their alkali salts or ammonium salts having a pH-buffering function, such as borax, sodium metaborate, acetic acid, sodium acetate, sodium carbonate, potassium carbonate, phosphorous acid, phosphoric acid, sodium phosphate, citric acid, sodium citrate, and tartaric acid, and ammonium nitrate, and guanidine as a corrosion inhibitor.

The fixing agent used in the bleach-fixing solution or the bleaching solution according to the present invention can use one or more of water-soluble silver halide solvents, for example thiosulfates, such as sodium thiosulfate and ammonium thiosulfate, thiocyanates, such as sodium thiocyanate and ammonium thiocyanate, thiourea compounds and thioether compounds, such as ethylenebisthioglycolic acid and 3,6-dithia-1,8-octanediol. For example, a special bleach-fixing solution comprising a combination of a fixing agent described in JP-A No. 155354/1980 and a large amount of a halide, such as potassium iodide, can be used. In the present invention, it is preferable to use thiosulfates, and particularly ammonium thiosulfate. The amount of the fixing agent per liter is preferably 0.3 to 2 mol, and more preferably 0.5 to 1.0 mol.

The pH range of the bleach-fixing solution or the fixing solution is preferably 3 to 10, and particularly preferably 5 to 9. If the pH is lower than this range, the desilvering is improved, but the deterioration of the solution and the leucolization of cyan dye are accelerated. In reverse, if the pH is higher than this range, the desilvering is retarded and stain is liable to occur.

To adjust pH, if necessary, a compound such as hydrochloric acid, sulfuric acid, nitric acid, acetic acid, bicarbonate, ammonia, caustic potassium, caustic soda, sodium carbonate and potassium carbonate may be added.

Further, the bleach-fixing solution may additionally contain various brightening agents, anti-foaming agents, surface-active agents, polyvinyl pyrrolidone, and organic solvents, such as methanol.

The bleach-fixing solution or the fixing solution used in the present invention contains, as a preservative, sulfites (e.g., sodium sulfite, potassium sulfite, and ammonium sulfite), bisulfites (e.g., ammonium bisulfite, sodium bisulfite, and potassium bisulfite), and methabisulfites (e.g., potassium metabisulfite, sodium metabisulfite, and ammonium metabisulfite). Preferably these compounds are contained in an amount of 0.02 to 0.50 mol/l, and more preferably 0.04 to 0.40 mol/l, in terms of sulfite ions.

As a preservative, generally a bisulfite is added, but other compounds, such as ascorbic acid, carbonyl bisulfite addition compound, sulfinic acid, sulfinic acid, or carbonyl compounds, may be added.

If required, for example, buffers, brightening agents, chelate agents, and mildew-proofing agents may be added.

In the desilvering process of the present invention, a bleach-fixing solution is preferably used. As described above, even in the short processing time, that is, in the condition where the above-described contaminated substances are not enough washed out, the effect of the present invention can be attained remarkably. The concrete processing time is preferably 20 sec. to 1 min, more preferably 20 sec. to 45 sec. The processing temperature is 30° to 45° C., preferably 33° to 38° C.

The silver halide color photographic material used in the present invention is generally washed and/or stabilized after the fixing or the desilvering, such as the bleach-fixing.

The amount of washing water in the washing step can be set over a wide range, depending on the characteristics of the photographic material (e.g., the characteristics of the materials used, such as couplers), the application of the photographic material, the washing water temperature, the number of the washing water tanks (stages), the type of replenishing (i.e., depending on whether the replenishing is of the countercurrent type or of the down flow type), and other various conditions. The relationship between the number of washing water tanks and the amount of water in the multi-stage countercurrent system can be determined based on the method described in *Journal of the Society of Motion Picture and Television Engineers,* Vol. 64, pp. 248 to 253 (May 1955).

According to the multi-stage countercurrent system, the amount of washing water can be reduced considerably. But a problem arises that bacteria can propagate due to the increase in the residence time of the water in the tanks, and the suspended matter produced will adhere to the photographic material. To solve such a problem in processing the color photographic material of the present invention, the process for reducing calcium and magnesium described in JP-A No. 288838/1987 can be used quite effectively. Further, isothiazolone compounds and thiabendazoles described in JP-A No. 8542/1982, chlorine-type bactericides, such as sodium chlorinated isocyanurates described in JP-A No. 120145/1986, benzotriazoles described in JP-A No. 267761/1986, copper ions, and bactericides described by Hiroshi Horiguchi in *Bokin Bobai-zai no Kagaku, Biseibutsu no Genkin, Sakkin, Bobai Gijutsu* (edited by Eiseigijutsu-kai), and *Bokin Bobai-zai Jiten* (edited by Nihon Bokin Bobai-gakkai), can be used.

The pH range of the washing water in the processing steps for the photographic material of the present invention may be 4 to 9, preferably 5 to 8. The temperature and time of washing, which can be set according to the use or property of the photographic material, is generally in the range 15° to 45° C. and 20 sec. to 10 min, preferably 25° to 40° C. and 30 sec. to 5 min.

Further, the photographic materials of the present invention can be processed directly by a stabilizing solution without a washing step. In such a stabilizing process, all known methods described, for example, in JP-A Nos. 8543/1982, 14834/1983, 184343/1984, 220345/1985, 238832/1985, 239784/1985, 239749/1985, 4045/1986, and 118749/1986 can be used. A preferred inclusion is to use a stabilizing bath containing 1-hydroxyethylidene-1,1-diphosphonate, 5-chloro-2-methyl-4-isothiazolone-3-one, a bismuth compound, or an ammonium compound.

In some cases a stabilizing process is carried out following the above-described washing process, and an example of such cases is a stabilizing bath containing formalin and a surface-active agent for use as a final bath for color photographic materials for photographing.

The processing time of washing and/or stabilizing process of the present invention is 20 sec. to 2 min, preferably 20 sec. to 1 min. 30 sec, and shorter the time the more remarkable effect can be attained.

If the quantity of the replenisher is to be reduced, it is preferable to prevent the solution, by making small the contact area of the processing tank with the air, from evaporating and being oxidized by the air. The contact area of the photographic processing solution in the processing tank with the air can be given by the opened surface ratio defined as follows:

$$\text{Opened surface ratio } (\text{cm}^{-1}) = \frac{\text{Contact surface area } (\text{cm}^2) \text{ of the processing solution with the air}}{\text{Whole volume } (\text{cm}^3) \text{ of the processing solution}}$$

"Contact surface area of the processing solution with the air" means a surface area of the developing solution that is not covered by anything such as floating lids or rollers.

It is preferable that the opened surface ratio is 0.1 $\text{cm}^{-1}$ or below, more preferably 0.001 to 0.05 $\text{cm}^{-1}$.

As means of reducing the opened surface ratio, a screening member, such as a floating lid, may be provided on the surface of the photographic processing solution in the processing tank, or a method described in Japanese Patent Application No. 241342/1987, wherein a movable lid is used, or a slit development processing method described in JP-A No. 216050/1988 can be employed.

It is preferably that the reduction of the opened surface ratio is applied not only to the color development step and the black-and-white development step, but also to all of the subsequent steps, such as the bleaching step, the bleach-fixing step, the fixing step, the washing step, and the stabilizing step.

The silver halide color photographic material of the present invention will now be described.

The thickness of the dried coatings of the silver halide color photographic material of the present invention is 15 μm or less, preferably 6 to 13 μm, and more preferably 6 to 10 μm. The thickness of the dried coatings is the thickness of the coatings measured by applying the coatings and allowing the photographic material to stand for 30 days at 25° C./60% RH, with the thickness of the base being excluded. When the thickness exceeds 15 μm, the adhesion of the deteriorated components of the developer increases, and the washing effect becomes inadequate, so that the effect of the present invention cannot be expected. It is preferable that the thickness is 6 μm or more in some cases in view of the productional aptitude.

Although generally it is preferable to adjust the thickness by the amount of gelatin and the amount of hardener, the thickness can be adjusted to a certain extent by the amount of other oil or couplers to be added and the amounts of the silver halide emulsions to be added. The amount of gelatin to be applied is 2 to 15 g per 1 $m^2$ of the photographic material, preferably in the order of 4 to 10 g per 1 $m^2$ of the photographic material. As the hardener, a triazine or a vinyl sulfone is preferably used.

The color photographic material of the present invention can be constituted by applying at least each of a blue-sensitive silver halide emulsion layer, a green-sensitive silver halide emulsion layer, and a red-sensitive silver halide emulsion layer on a base. For common color print papers, the above silver halide emulsion layers are applied in the above-stated order on the base, but the order may be changed. Color reproduction by the subtractive color process can be performed by incorporating, into these photosensitive emulsion layers, silver halide emulsions sensitive to respective wavelength ranges, and so-called colored-couplers capable of forming dyes complementary to light to which the couplers are respectively sensitive, that is, capable of forming yellow complementary to blue, magenta complementary to green, and cyan complementary to red. However, the constitution may be such that the photosensitive layers and the color formed from the couplers do not have the above relationship.

In the present invention, the coating amount of silver halide is 1.5 $g/m^2$ or less, preferably 0.8 $g/m^2$ or less and 0.3 $g/m^2$ or more, in terms of silver. A coating amount of 0.8 $g/m^2$ or less is very preferably in view of rapidness, processing-stability, and storage-stability of image after processing )in particular, restraint of yellow stain). Further, the coating silver amount is preferably 0.3 $g/m^2$ or over, in view of image-density. From these points of view the coating amount of silver halide in terms of silver is more preferably 0.3 to 0.75 $gm^2$, particularly preferably 0.4 to 0.7 $gm^2$.

As the silver halide emulsion used in the present invention, one comprising silver chlorobromide or silver chloride and being substantially free from silver iodide can be preferably used. Herein the term "substantially free from silver iodide" means that the silver iodide content is 1 mol % or below, and preferably 0.2 mol % or below. Although the halogen compositions of the emulsions may be the same or different from grain to grain, if emulsions whose grains have the same halogen composition are used, it is easy to make the properties of the grains homogeneous. With respect to the halogen composition distribution in a silver halide emulsion grain, for example, a grain having a so-called uniform-type structure, wherein the composition is uniform throughout the silver halide grain, a grain having a so-called layered-type structure, wherein the halogen composition of the core of the silver halide grain is different from that of the shell (which may comprises a single layer or layers) surrounding the core, or a grain having a structure with nonlayered parts different in halogen composition in the grain or on the surface of the grain (if the nonlayered parts are present on the surface of the grain, the structure has parts different in halogen composition joined onto the edges, the corners, or the planes of the grain) may be suitably selected and used. To secure high sensitivity, it is more advantageous to use either of the latter two than to use grains having a uniform-type structure, which is also preferable in view of the pressure resistance. If the silver halide grains have the above-mentioned structure, the boundary section between parts different in halogen composition may be a clear boundary, or an unclear boundary, due to the formation of mixed crystals caused by the difference in composition, or it may have positively varied continuous structures.

As to the silver halide composition of these silver chlorobromide emulsions, the ratio of silver bromide/silver chloride can be selected arbitrarily. That is, the ratio is selected from the broad range in accordance with the purpose, but the ratio of silver chloride in a silver chlorobromide is preferably 2% or over.

Further in the photographic material suitable for a rapid processing a emulsion of high silver chloride content, so-called a high-silver-chloride emulsion may be used preferably. The content of silver chloride of the high-silver-chloride emulsion is preferably 90 mol % or over, more preferably 95 mol % or over.

In these high-silver-chloride emulsions, the structure is preferably such that the silver bromide localized layer in the layered form or nonlayered form is present in the silver halide grain and/or on the surface of the silver halide grain as mentioned above. The silver bromide content of the composition of the above-mentioned localized layer is preferably at least 10 mol %, and more preferably over 20 mol %. The localized layer may be present in the grain, or on the edges, or corners of the grain surfaces, or on the planes of the grains, and a preferable example is a localized layer epitaxially grown on each corner of the grain.

On the other hand, for the purpose of suppressing the lowering of the sensitivity as much as possible when the photographic material undergoes pressure, even in the case of high-silver-chloride emulsions having a silver chloride content of 90 mol % or over, it is preferably also practiced to use grains having a uniform-type structure, wherein the distribution of the halogen composition in the grain is small.

In order to reduce the replenishing amount of the development processing solution, it is also effective to increase the silver chloride content of the silver halide emulsion. In such a case, an emulsion whose silver chloride is almost pure, that is, whose silver chloride content is 98 to 100 mol %, is also preferably used.

The average grain size of the silver halide grains contained in the silver halide emulsion used in the present invention (the diameter of a circle equivalent to the projected area of the grain is assumed to be the grain size, and the number average of grain sizes is assumed to be an average grain size) is preferably 0.1 to 2 μm.

Further, the grain size distribution thereof is preferably one that is a so-called monodisperse dispersion, having a deviation coefficient (obtained by dividing the standard deviation of the grain size by the average grain size) of 20% or below, and desirably 15% or below. In this case, for the purpose of obtaining one having a wide latitude, it is also preferable that monodisperse emulsions as mentioned above are blended to be used in the same layer, or are applied in layers.

As to the shape of the silver halide grains contained in the photographic emulsion, use can be made of grain in a regular crystal form, such as cubic, tetradecahedral, or octahedral, or grains in an irregular crystal form, such as spherical or planar, or grains that are a composite of these. Also, a mixture of silver halide grains having various crystal forms can be used. In the present invention, of these, grains containing grains in a regular crystal form in an amount of 50% or over, preferably 70% or over, and more preferably 90% or over, are preferred.

Further, besides those mentioned above, an emulsion wherein the tabular grains having an average aspect ratio (the diameter of a circle calculated/the thickness) of 5 or over, and preferably 8 or over, exceed 50% of the total of the grains in terms of the projected area, can be preferably used.

Into the silver halide emulsion used in the present invention, various polyvalent metal ion impurities can be introduced during the formation or physical ripening of the emulsion grains. Examples of such compounds to be used include salts of cadmium, zinc, lead, copper, and thallium, and salts or complex salts of an element of Group VIII, such as iron, ruthenium, rhodium, palladium, osmium, iridium, and platinum. Particularly the elements of Group VIII can be preferably used. Although the amount of these compounds to be added varies over a wide range according to the purpose, preferably the amount is $10^{-9}$ to $10^{-2}$ mol for the silver halide.

The silver halide emulsion used in the present invention is generally chemically sensitized and spectrally sensitized.

As the chemical sensitization method, sulfur sensitization, wherein typically an unstable sulfur compound is added, noble metal sensitization, represented by gold sensitization, or reduction sensitization can be used alone or in combination. As the compounds used in the chemical sensitization, preferably those described in JP-A No. 215272/1987, page 18 (the right lower column) to page 22 (the right upper column), are used.

The silver chloromide emulsion used in the present invention can be prepared by methods described, for example, by P. Glafkides, *in Chimie et Phisique Photographique* (published by Paul Montel, 1967), by G. F. Duffin in *Photographic Emulsion Chemistry* (published by Focal Press, 1966), and by V. L. Zelikman et al. in *Making and Coating Photographic Emulsion* (published by Focal Press, 1964). That is, any of the acid process, the neutral process, the ammonia process, etc. can be used, and to react a soluble silver salt and a soluble halide, for example, any of the single-jet process, the double-jet process, or a combination of these can be used. A process of forming grains in an atmosphere having excess silver ions (the so-called reverse precipitation process) can also be used. A process wherein the pAg in the liquid phase where a silver halide is to be formed is kept constant, that is, the so-called controlled double-jet process, can be used as one type of double-jet process. According to the controlled double-jet process, a silver halide emulsion wherein the crystal form is regular and the grain sizes are nearly uniform can be obtained.

The spectral sensitization is carried out for the purpose of providing the emulsions of the layers of the photographic material of the present invention with spectral sensitivities in desired wavelength regions. In the present invention, the spectral sensitization is preferably carried out by adding dyes that absorb light in the wavelength ranges corresponding to the desired spectral sensitivities, that is, by adding spectrally sensitizing dyes. As the spectrally sensitizing dyes used herein, for example, those described by F. M. Harmer in "Heterocyclic compounds—Cyanine dyes and related compounds" (published by John Wiley & Sons [New York, London], 1964) can be mentioned. As specific examples of the compounds and the spectral sensitization method, those described in the above JP-A No. 215272/1987, page 22 (the right upper column) to page 38, are preferably used.

In the silver halide emulsion used in the present invention, various compounds or their precursors can be added for the purpose of stabilizing the photographic performance or preventing fogging that will take place during the process of the production of the photographic material, or during the storage or photographic processing of the photographic material. As specific examples of these compounds, those described in the above-mentioned JP-A No. 215272/1987, pages 39 to 72, are preferably used.

As the emulsion used in the present invention, use is made of a so-called surface-sensitive emulsion, wherein a latent image is formed mainly on the grain surface, or of a so-called internal-image emulsion, wherein a latent image is formed mainly within the grains.

When the present invention is used for color photographic materials, generally in the color photographic material are used a yellow coupler, a magenta coupler, and a cyan coupler, which will couple with the oxidized product of the aromatic amine color-developing agent to form yellow, magenta, and cyan.

Cyan couplers, magenta couplers, and yellow couplers preferably used in the present invention are those represented by the following formulae (C-1), (C-II), (M-I), (M-II), and (Y):

Formula (C-I)

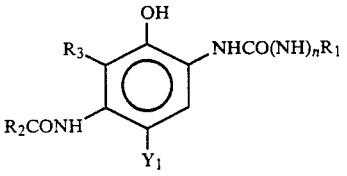

Formula (C-II)

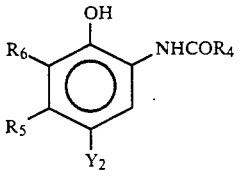

Formula (M-I)

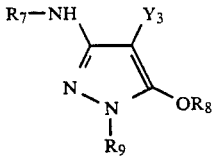

Formula (M-II)

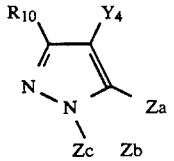

Formula (Y)

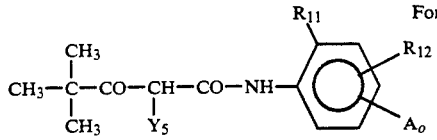

In formulae (C-I) and (C-II), $R_1$, $R_2$, and $R_4$ each represent a substituted or unsubstituted aliphatic, aromatic, or heterocyclic group, $R_3$, $R_5$, and $R_6$ each represent a hydrogen atom, a halogen atom, an aliphatic group, an aromatic group, or an acylamino group, $R_3$ and $R_2$ together may represent a group of nonmetallic atoms to form a 5- or 6-membered ring, $Y_1$ and $Y_2$ each represent a hydrogen atom or a group that is capable of coupling off with the oxidation product of a developing agent, and n is 0 or 1.

In formula (C-II), $R_5$ preferably represents an aliphatic group such as a methyl group, an ethyl group, a propyl group, a butyl group, a pentadecyl group, a tert-butyl group, a cyclohexyl group, a cyclohexylmentyl group, a phenylthiomethyl group, a dodecyloxyphenylthiomethyl group, a butaneamidomethyl group, and a methoxymethyl group.

Preferable examples of the cyan couplers represented by formulae (C-I) and (C-II) are given below:

In formula (C-I), preferable $R_1$ is an aryl group or a heterocyclic group, and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

In formula (C-I), when $R_3$ and $R_2$ together do not form a ring, $R_2$ is preferably a substituted or unsubstituted alkyl group, or aryl group, and particularly preferably an alkyl group substituted by a substituted aryloxy, and preferably $R_3$ represents a hydrogen atom.

In formula (C-II), preferable $R_4$ is a substituted or unsubstituted alkyl group or aryl group, and particularly preferably an alkyl group substituted by a substituted aryloxy group.

In formula (C-II), preferable $R_5$ is an alkyl group having 2 to 15 carbon atoms, or a methyl group substituted by a substituent having 1 or more carbon atoms, and the substituent is preferably an arylthio group, an alkylthio group, an acylamino group, an aryloxy group, or an alkyloxy group.

In formula (C-II), preferably $R_5$ is an alkyl group having 2 to 15 carbon atoms, and particularly preferably an alkyl group having 2 to 4 carbon atoms.

In formula (C-II), preferable $R_6$ is a hydrogen atom or a halogen atom, and particularly preferably a chlorine atom or a fluorine atom. In formulae (C-I) and (C-II), preferable $Y_1$ and $Y_2$ each represent a hydrogen atom, a halogen atom, an alkoxy group, an aryloxy group, an acyloxy group, or a sulfonamido group.

In formula (M-I), $R_7$ and $R_9$ each represent an aryl group, $R_8$ represents a hydrogen atom, an aliphatic or aromatic acyl group, an aliphatic or aromatic sulfonyl group, and $Y_3$ represents a hydrogen atom or a coupling split-off group. Allowable substituents of the aryl group represented by $R_7$ and $R_9$ are the same substituents as those allowable for the substituent $R_1$, and if there are two substituents, they may be the same or different. $R_8$ is preferably a hydrogen atom, an aliphatic acyl group, or a sulfonyl group, and particularly preferably a hydrogen atom. Preferable $Y_3$ is of the type that will split-off at one of a sulfur atom, an oxygen atom, and a nitrogen atom, and particularly preferably of the sulfur atom split-off type described, for example, in U.S. Pat. No. 4,351,897 and International Publication Patent No. WO 88/04795.

In formula (M-II), $R_{10}$ represents a hydrogen atom or a substituent. $Y_4$ represents a hydrogen atom or a coupling split-off group, and particularly preferably a halogen atom or an arylthio group. Za, Zb, and Zc each represent methine, a substituted methine, =N—, or —NH—, and one of the Za—Zb bond and the Zb—Zc bond is a double is a carbon-carbon double bond, it may be part of the aromatic ring. A dimer or more higher polymer formed through $R_{10}$ or $Y_4$ is included, and if Za, Zb, or Zc is a substituted methine, a dimer or more higher polymer formed through that substituted methine is included.

Of the pyrazoloazole couplers represented by formula (M-II), imidazo[1,2-b]pyrazoles described in U.S. Pat. No. 4,500,630 are preferable in view of reduced yellow subsidiary absorption of the color-formed dye and light-fastness, and pyrazolo[1,5-b][1,2,4]triazoles described in U.S. Pat. No. 4,540,654 are particularly preferable.

Further, use of pyrazolotriazole couplers wherein a branched alkyl group is bonded directly to the 2-, 3-, or 6-position of a pyrazolotriazole ring, as described in JP-A No. 65245/1976, pyrazoloazole couplers containing a sulfonamido group in the molecule, as described in JP-A No. 65246/1986, pyrazoloazole couplers having an alkoxyphenylsulfonamido ballasting group, as described in JP-A No. 147254/1986, and pyrazolotriazole couplers having an aryloxy group or an alkoxy group in the 6-position, as described in European Patent (Publication) Nos. 226,849 and 294,785, is preferable.

In formula (Y), $R_{11}$ represents a halogen atom, an alkoxy group, a trifluoromethyl group, or an aryl group, and $R_{12}$ represents a hydrogen atom, a halogen atom, or an alkoxy group. $A_0$ represents —$NHCOR_{13}$, —$NHSO_2$—$R_3$, —$SO_2NHR_{13}$, —$COOR_{13}$, or $$-SO_2\underset{\underset{R_{14}}{|}}{N}-R_{13},$$

wherein $R_{13}$ and $R_{14}$ each represent an alkyl group, an aryl group, or an acyl group. $Y_5$ represents a coupling split-off group. Substituents of $R_{12}$, $R_{13}$, and $R_{14}$ are the same as those allowable for $R_1$, and the coupling split-off group $Y_5$ is of the type that will split off preferably at an oxygen atom or a nitrogen atom, and particularly preferably it is of the nitrogen atom split-off type.

Specific examples of couplers represented by formulae (C-I), (C-II), (M-I), (M-II) and (Y) are listed below.

(C-1)

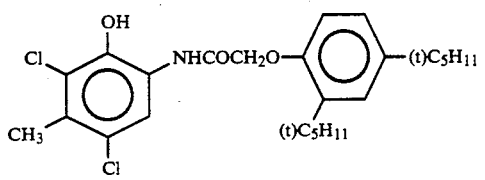

(C-2)

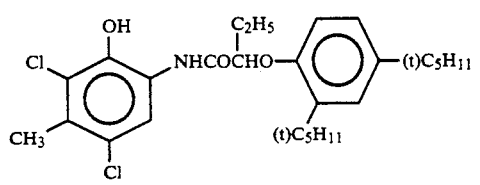

(C-3)

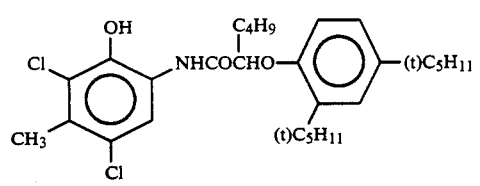

(C-4)

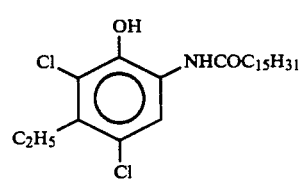

(C-5)

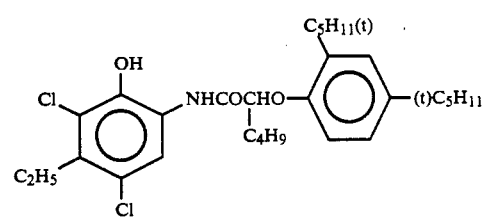

-continued
(C-6)
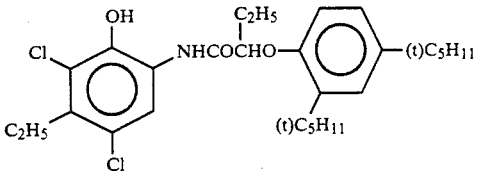
(C-7)
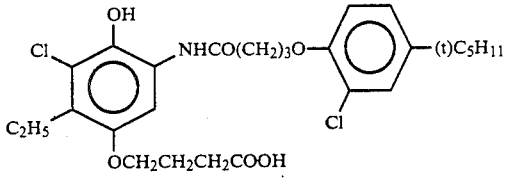
(C-8)
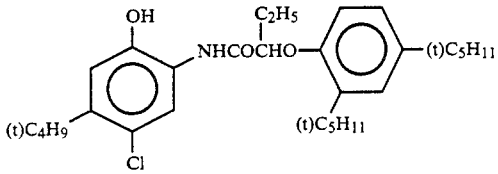
(C-9)
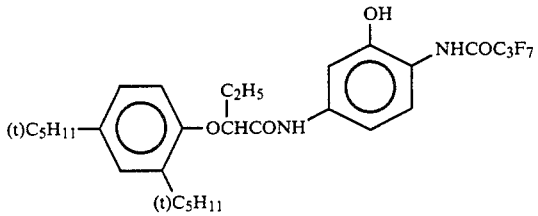
(C-10)
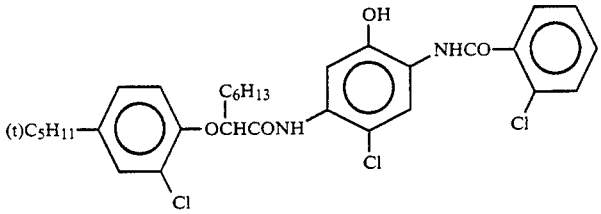
(C-11)
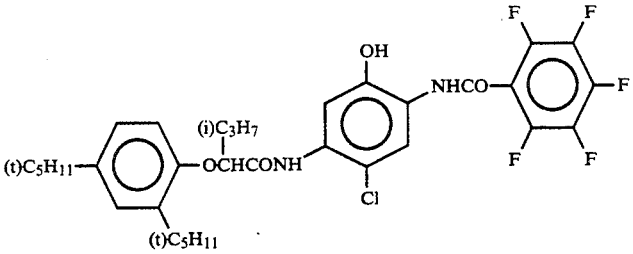
(C-12)
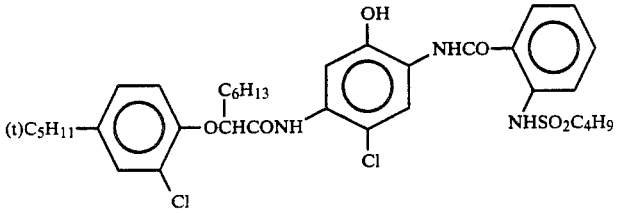

-continued
(C-13)
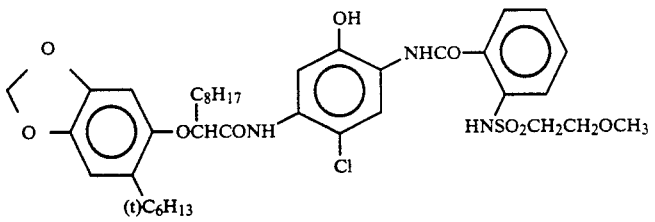
(C-14)
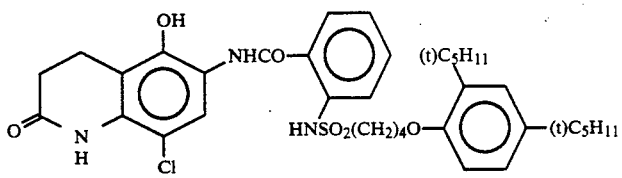
(C-15)
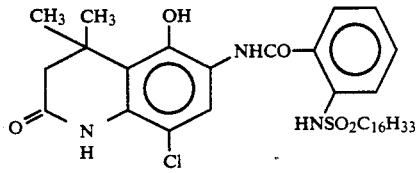
(C-16)
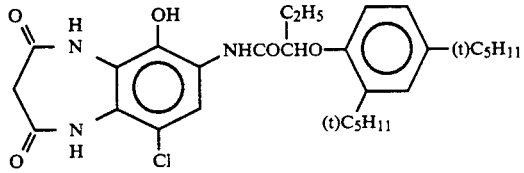
(C-17)
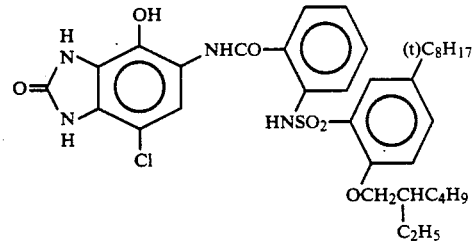
(C-18)
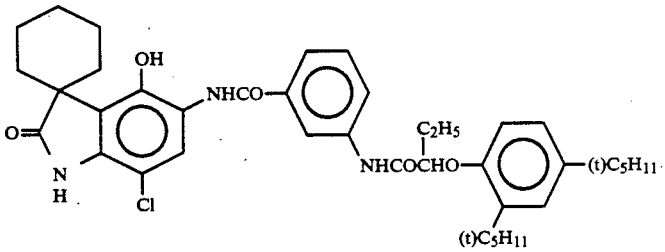
(C-19)
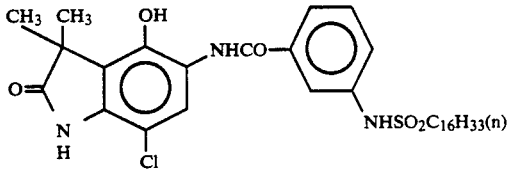

-continued
(C-20)
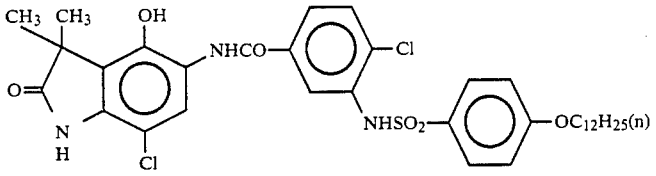
(C-21)
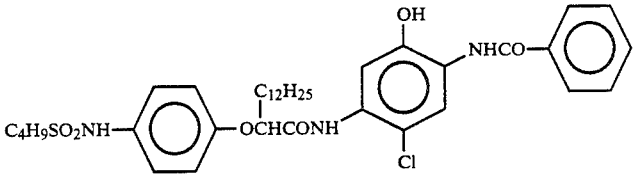
(C-22)
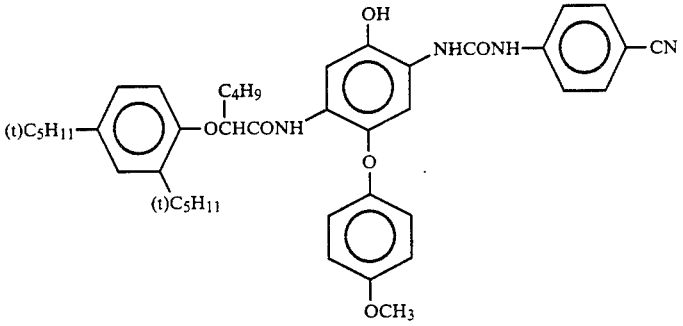
(M-1)
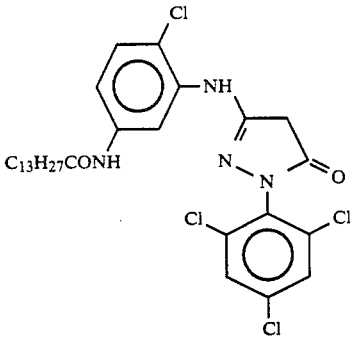
(M-2)
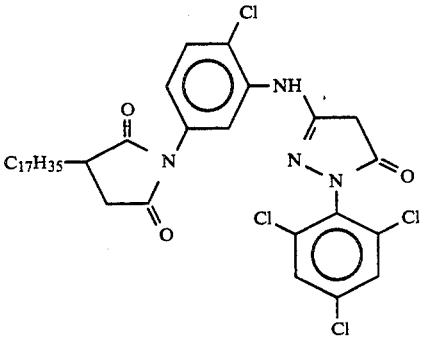

-continued
(M-3)
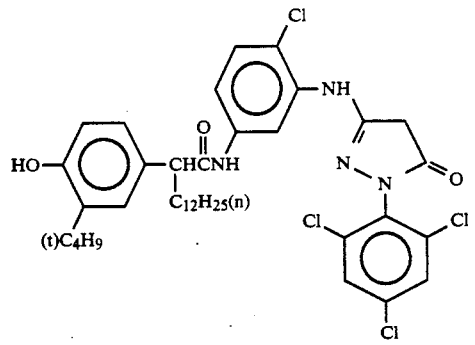
(M-4)
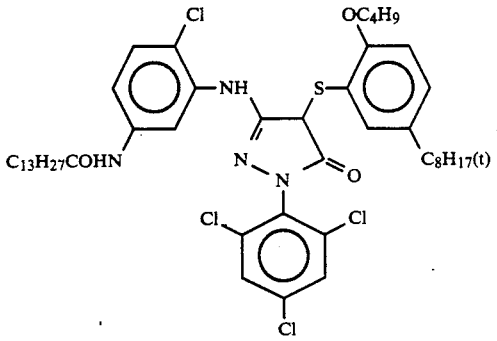
(M-5)
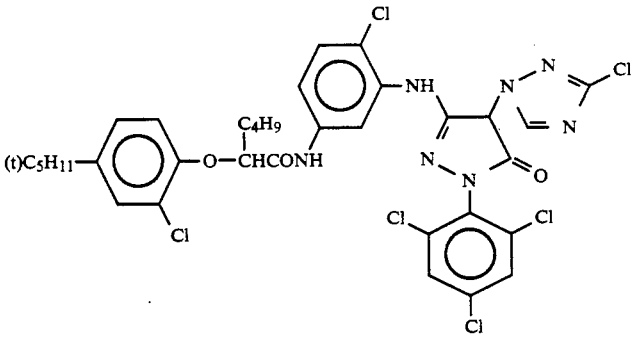
(M-6)
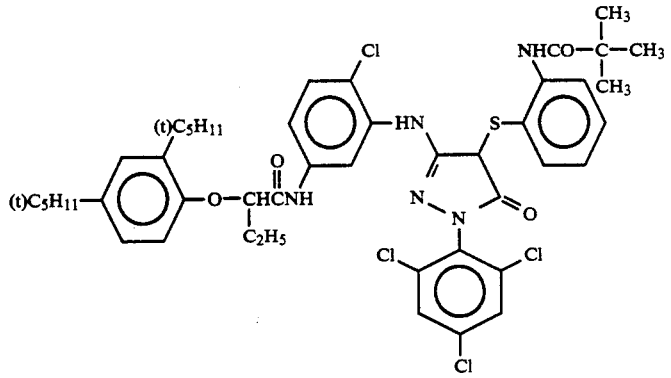

-continued
(M-7)
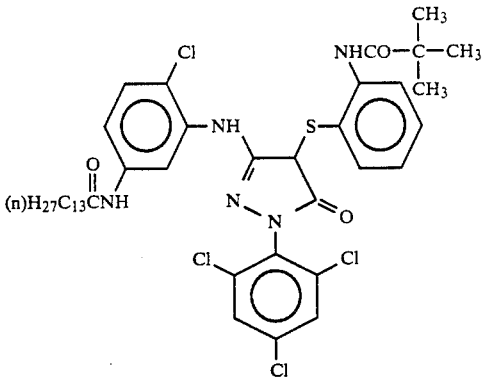
(M-8)
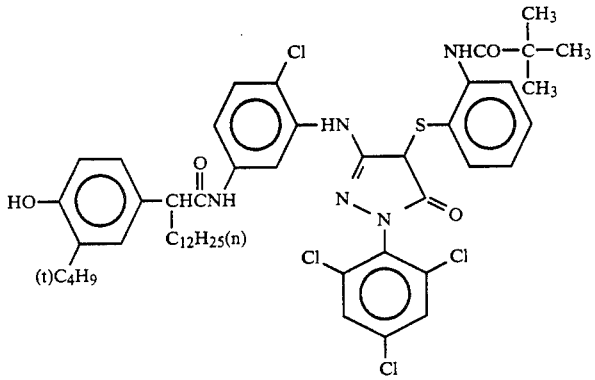

| Compound | $R_{10}$ | $R_{15}$ | $Y_4$ |
|---|---|---|---|
| | | 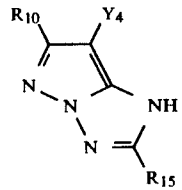 | |
| M-9 | $CH_3$— | 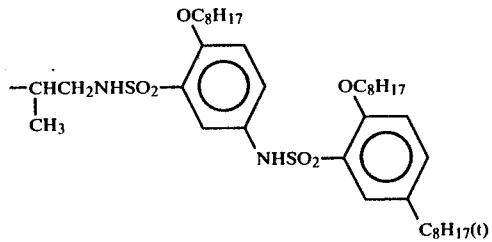 | Cl |
| M-10 | The same as the above | 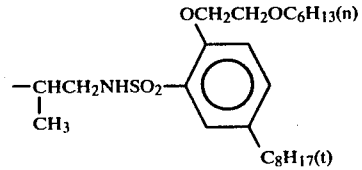 | The same as the above |
| M-11 | $(CH_3)_3C$— | 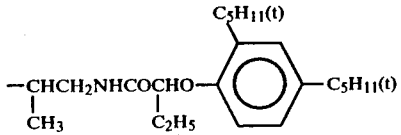 | 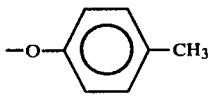 |
| M-12 | 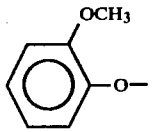 | 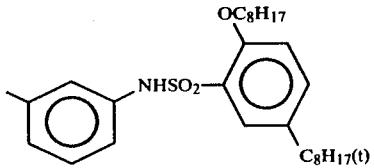 | 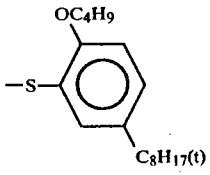 |

-continued
| Compound | $R_{10}$ | $R_{15}$ | $Y_4$ |
|---|---|---|---|
| M-13 | $CH_3$— | 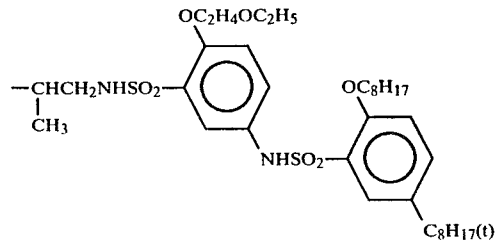 | Cl |
| M-14 | The same as the above | 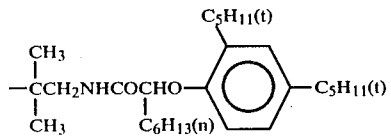 | The same as the above |
| M-15 | The same as the above | 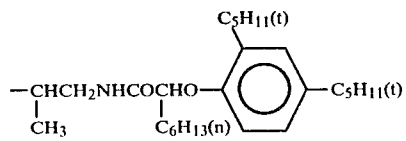 | The same as the above |
| M-16 | The same as the above | 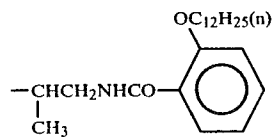 | The same as the above |
| M-17 | The same as the above | 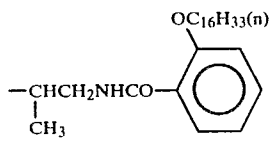 | The same as the above |

-continued
| Compound | $R_{10}$ | $R_{15}$ | $Y_4$ |
|---|---|---|---|
| M-18 | 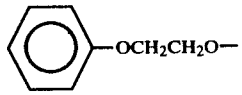 | 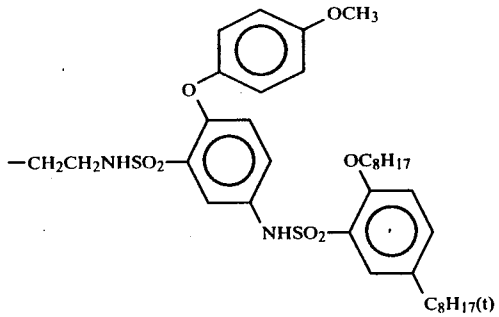 | 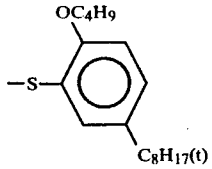 |
| M-19 | $CH_3CH_2O-$ | The same as the above | The same as the above |
| M-20 | 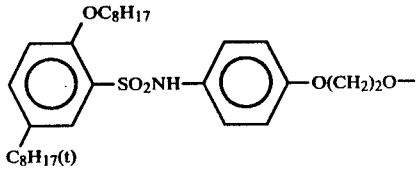 | 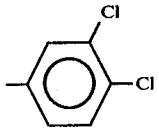 | 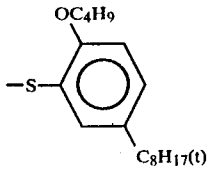 |
| M-21 | 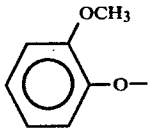 | 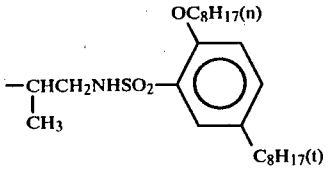 | Cl |
| | 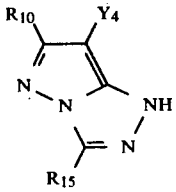 | | |
| M-22 | $CH_3-$ | 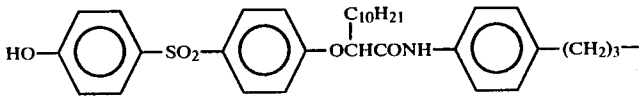 | Cl |

-continued

| Compound | $R_{10}$ | $R_{15}$ | $Y_4$ |
|---|---|---|---|
| M-23 | The same as the above | $(n)C_6H_{13}$ \ $CHCH_2SO_2-(CH_2)_2-$ / $(n)C_8H_{17}$ | The same as the above |
| M-24 | $CH_3$ \ $CH-$ / $CH_3$ | $OC_4H_9$; $-SO_2-(CH_2)_3-$; $C_8H_{17}(t)$ | The same as the above |
| M-25 | $-(CH-CH_2)_{50}-(CH_2-C)_{50}-$ ($CH_3$; $COOCH_2CH_2OCH_3$; $CONH-$) | $CH_3-CH-$ ($CH_2NHSO_2CH_3$) | The same as the above |
| M-26 | $-O-$ | $OC_8H_{17}$; $-(CH_2)_2NHSO_2-$; $C_8H_{17}(t)$ | The same as the above |
| M-27 | $CH_3-$ | $CH_3$; $CH_3$; $CH_3$; $NHCOCHO-$ ($(n)C_{10}H_{21}$); $-SO_2-$; $-OCH_2-$ | Cl |
| M-28 | $(CH_3)_3C-$ | $CH_3$; $CH_3$; $CH_3$; $C_5H_{11}(t)$; $NHCOCHO-$ ($C_4H_9(n)$); $-C_5H_{11}(t)$ | The same as the above |

-continued
| Compound | $R_{10}$ | $R_{15}$ | $Y_4$ |
|---|---|---|---|
| M-29 | 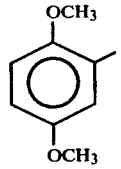 | 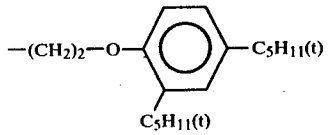 | The same as the above |
| M-30 | $CH_3-$ | $-CH(C_2H_5)-N(n)C_{18}H_{37}COCH_2CH_2COOH$ | The same as the above |

(Y-1)
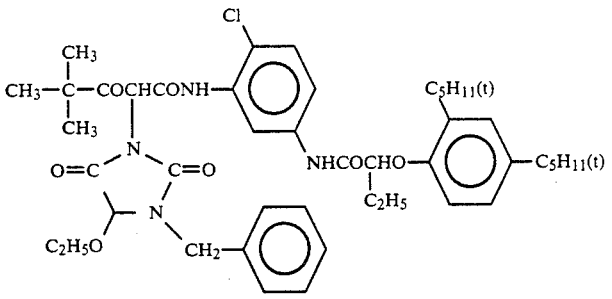
(Y-2)
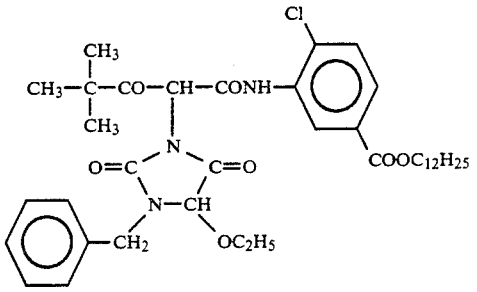
(Y-3)
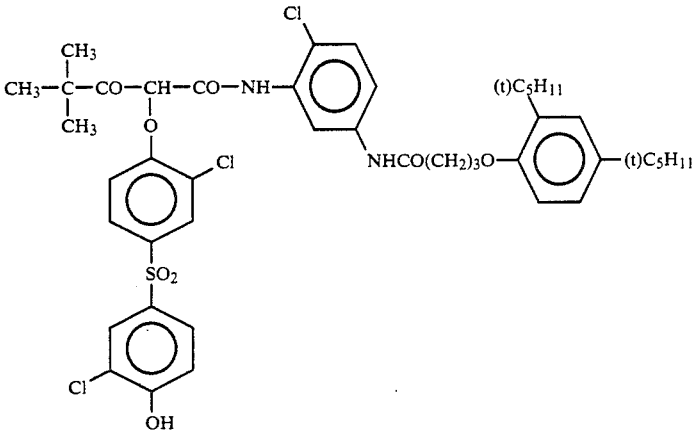
(Y-4)
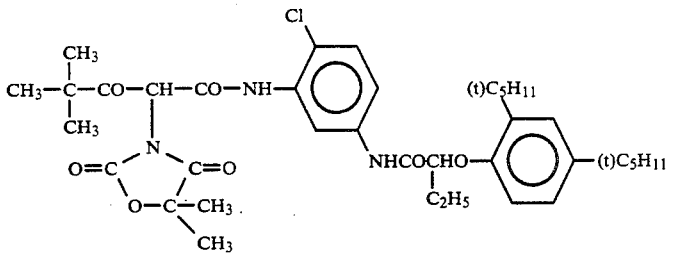
(Y-5)
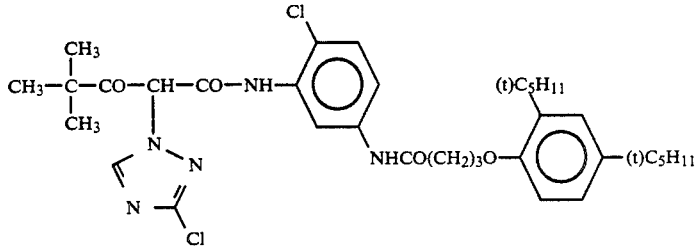

-continued (Y-6)

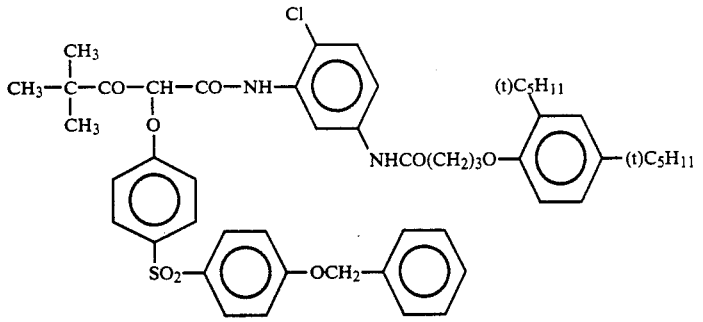

(Y-7)

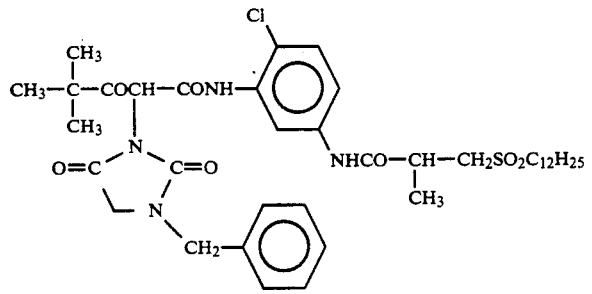

(Y-8)

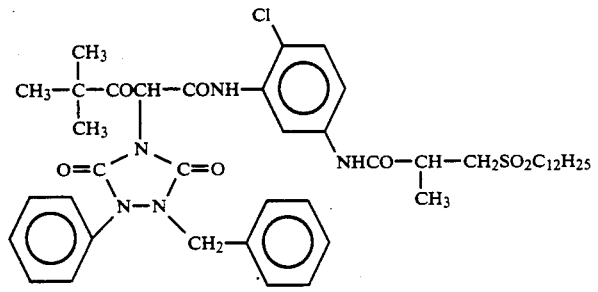

(Y-9)

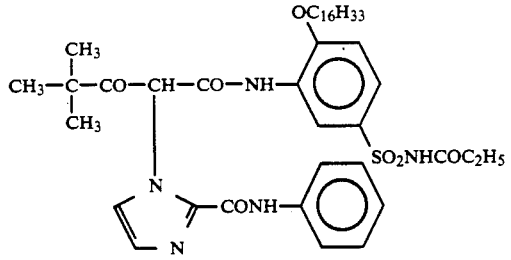

The couplers represented by formulae (C-I) to (Y) may be contained in the silver halide emulsion layer constituting the photographic layer generally in an amount of 0.1 to 1.0 mol, preferably 0.1 to 0.5 mol, per mol of the silver halide.

In the present invention, in order to add the coupler to the photographic layer, various known techniques can be applied. Generally, the oil-in-water dispersion method known, as the oil-protect method, can be used for the addition, that is, after the coupler is dissolved in a solvent, it is emulsified and dispersed into an aqueous gelatin solution containing a surface-active agent. Alternatively, it is also possible that the coupler solution containing a surface-active agent can be added to water or an aqueous gelatin solution to form an oil-in-water dispersion with phase reversal of the emulsion. In the case of an alkali-soluble coupler, it can be dispersed by the so-called Fisher dispersion method. It is also possible that the low-boiling organic solvent can be removed from the coupler dispersion by means of distillation, noodle washing, ultrafiltration, or the like, followed by mixing with the photographic emulsion.

As the dispersion medium for the couplers, it is preferable to use a high-boiling organic solvent and/or a water-insoluble polymer compound having a dielectric constant of 2 to 20 (25° C.) and a refractive index of 1.5 to 1.7 (25° C.).

As the high-boiling organic solvent, a high-boiling organic solvent represented by the following formula (A), (B), (C), (D), or (E) is preferably used.

Formula (A)

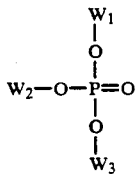

-continued $W_1-COO-W_2$ Formula (B)

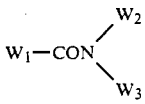

Formula (C)

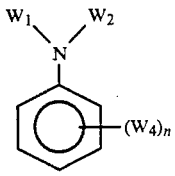

Formula (D)

$W_1-O-W_2$ Formula (E)

wherein $W_1$, $W_2$, and $W_3$ each represent a substituted or unsubstituted alkyl group, cycloalkyl group, alkenyl group, aryl group or heterocyclic group, $W_4$ represents $W_1$, $OW_1$or S-$W_1$, n is an integer of 1 to 5, when n is 2 or over, $W_4$ groups may be the same or different, and in formula (E), $W_1$ and $W_2$ may together form a condensed ring.

As the high-boiling organic solvent used in the present invention, any compound other than compounds represented by formulae (A) to (E) can also be used if the compound has a melting point of 100° C. or below and a boiling point of 140° C. or over, and if the compound is incompatible with water and is a good solvent for the coupler. Preferably the melting point of the high-boiling organic solvent is 80° C. or below. Preferably the boiling point of the high-boiling organic solvent is 160° C. or over, and more preferably 170° C. or over.

Details of these high-boiling organic solvents are described in JP-A No. 215272/1987, page 137 (the right lower column) to page 144 (the right upper column).

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

The photographic material that is prepared by using the present invention may contain, as color antifoggant, for example, a hydroquinone derivative, an aminophenol derivative, a gallic acid derivative, or an ascorbic acid derivative.

In the photographic material of the present invention, various anti-fading agent (discoloration preventing agent) can be used. That is, as organic anti-fading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, methylenedioxybenzenes, aminophenols, hindered amines, and ether or ester derivatives obtained by silylating or alkylating the phenolic hydroxyl group of these compounds can be mentioned typically. Metal complexes such as (bissalicylaldoximato)nickel complex and (bis-N,N-dialkyldithiocarbamato)nickel complexes can also be used.

Specific examples of the organic anti-fading agents are described in the following patent specifications:

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Pat. No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337 and JP-A No. 152225/1987; spiroindanes are described in U.S. Pat. No. 4,360,589; p-alkoxyphenols are described, for example, in U.S. Pat. No. 2,735,765, British Pat. No. 2,066,975, JP-A No. 10539/1984, and JP-B No. 19765/1982; hindered phenols are described, for example, in U.S. Pat. Nos. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079 and 4,332,886, and JP-B No. 21144/1981 respectively; hindered amines are described, for example, in U.S. Pat. Nos. 3,336,135, 4,268,593, British Pat. Nos. 1,326,889, 1,354,313, and 1,410,846, JP-B No. 1420/1976, and JP-A Nos. 114036/1983, 53846/1984, and 78344/1984; and metal complexes are described, for example, in U.S. Pat. Nos. 4,050,938 and 4,241,155 and British Patent 2,027,731(A). To attain the purpose, these compounds can be added to the photosensitive layers by coemulsifying them with the corresponding couplers, with the amount of each compound being generally 5 to 100 wt % for the particular coupler. To prevent the cyan dye image from being deteriorated by heat, and in particular light, it is more effective to introduce an ultraviolet absorber into the cyan colorforming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), cinnamic acid ester compounds (e.g., those described in U.S. Pat. Nos. 3,705,805 and 3,707,395), butadiene compounds (e.g., those described in U.S. Pat. No. 4,045,229), or benzoxazole compounds (e.g., those described in U.S. Pat. Nos. 3,406,070, 3,677,672, and 4,271,207) can be used. Ultraviolet-absorptive couplers (e.g., α-naphthol type cyan dye forming couplers) and ultraviolet-absorptive polymers can, for example, be used also. These ultraviolet-absorbers may be mordanted in a particular layer.

In particular, the above-mentioned aryl-substituted benzotriazole compounds are preferable.

In the present invention, together with the above couplers, in particular together with the pyrazoloazole coupler, the following compounds are preferably used.

That is, it is preferred that a compound (F), which will chemically bond to the aromatic amide developing agent remaining after the color-developing process, to form a chemically inactive and substantially colorless compound, and/or a compound (G), which will chemically bond to the oxidized product of the aromatic amide color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine a the second-order reaction-specific rate $k_2$ (in trioctyl phosphate at 80° C.) in the range of 1.0 l/mol.sec to $1\times10^{-5}$ l/mol.sec. The second-order reaction- specific rate can be determined by the method described in JP-A No. 158545/1983.

If $k_2$ is over this range, the compound itself becomes unstable, and in some cases the compound reacts with gelatin or water to decompose. On the other hand, if $k_2$ is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII)

$$R'_1-(A')n-X' \qquad \text{Formula (FI)}$$

$$R'_2-\underset{\underset{B'}{|}}{C}=Y' \qquad \text{Formula (FII)}$$

wherein $R'_1$ and $R'_2$ each represent an aliphatic group, an aromatic group, or a heterocyclic group, n is 1 or 0, A' represents a group that will react with an aromatic amine developing agent to form a chemical bond therewith, X' represents a group that will react with the aromatic amine developing agent and split off, B' represents a hydrogen atom, an aliphatic group, an aromatic group, a heterocyclic group, an acyl group, or a sulfonyl group, Y' represents a group that will facilitate the addition of the aromatic amine developing agent to the compound represented by formula (FII), and $R'_1$ and X', or Y' and $R'_2$ or B', may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 28338/1987, 2042/1989, and 86139/1989.

On the other hand, more preferable examples of compound (G), which will chemically bond to the oxidized product of the aromatic amine developing agent remaining after color development processing, to form a chemically inactive and colorless compound, can be represented by the following formula (GI):

$$R'_3-Z \qquad \text{Formula (GI)}$$

wherein $R'_3$ represents an aliphatic group, an aromatic group, or a heterocyclic group, Z represents a nucleophilic group or a group that will decompose in the photographic material to release a nucleophilic group. Preferably the compounds represented by formula (GI) are ones wherein Z represents a group whose Pearson's nucleophilic $^{n}CH_3I$ value (R. G. Pearson, et al., *J. Am. Chem. Soc.*, 19 (1968)) is 5 or over, or a group derived therefrom.

Specific examples of compounds represented by formula (GI) are described, for example, in European Published Patent No. 255722, JP-A Nos. 143048/1987 and 229145/1987, Japanese Patent Application No. 136724/1988, and European Published Patent Nos. 298321 and 277589.

Details of combinations of compound (G) and compound (F) are described in European Published Patent No. 277589.

The photographic material prepared in accordance with the present invention may contain, in the hydrophilic colloid layer, water-soluble dyes as filter dyes or to prevent irradiation, and for other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the present photographic material, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

As a base to be used in the present invention, a transparent film, such as cellulose nitrate film, and polyethylene terephthalate film or a reflection-type base that is generally used in photographic materials can be used. For the objects of the present invention, the use of a reflection-type base is more preferable.

The "reflection base" to be used in the present invention is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin.

As the other reflection base, a base having a metal surface of mirror reflection or secondary diffuse reflection may be used. A metal surface having a spectral reflectance in the visible wavelength region of 0.5 or more is preferable and the surface is preferably made to show diffuse reflection by roughening the surface or by using a metal powder. The surface may be a metal plate, metal foil or metal thin layer obtained by rolling, vapor deposition or galvanizing of metal such as, for example, aluminum, tin, silver, magnesium and alloy thereof. Of these, a base obtained by vapor deposition of metal is preferable. It is preferable to provide a layer of water resistant resin, in particular, a layer of thermoplastic resin. The opposite side to metal surface side of the base according to the present invention is preferably provided an antistatic layer. The details of such base are describe, for example, in JP-A Nos. 210346/1986, 24247/1988, 24251/1988 and 24255/1988.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6 μm×6 μm, and measuring the occupied area ratio (%) (Ri) of the finely divided particles projected onto the unit areas. The deviation coefficient of the occupied area ratio (%) can be obtained based on the ratio $s/\overline{R}$, wherein s stands for the standard deviation of Ri, and $\overline{R}$ stands for the average value of Ri. Preferably, the number (n) of the unit areas to be subjected is 6 or over. Therefore, the deviation coefficient $s/\overline{R}$ can be obtained by $$\sqrt{\frac{\sum_{i=1}^{n}(R_i - R)^2}{n-1}} \Big/ \frac{\sum_{i=1}^{n} R_i}{n}$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform."

Next, the present invention will be described in detail in accordance with examples, but the invention is not limited to these examples.

EXAMPLE 1

A multilayer photographic material was prepared by multi-coatings composed of the following layer composition on a two-side polyethylene laminated paper support. Coating solutions were prepared as follows:

Preparation of the first layer coating solution

To a mixture of 19.1 g of yellow coupler (ExY), 4.4 g of image-dye stabilizer (Cpd-1) and 0.7 g of image-dye stabilizer (Cpd-7), 27.2 ml of ethyl acetate and 8.2 g of solvent (Solv-1) were added and dissolved. The resulting solution was dispersed and emulsified in 185 ml of 10% aqueous gelatin solution containing 8 ml of sodium dodecylbenzenesulfonate. Separately another emulsion was prepared by adding two kinds of blue-sensitive sensitizing dye, shown below, to a blend of silver chlorobromide emulsions (cubic grains, 3:7 (silver mol ratio) blend of grains having 0.88 μm and 0.7 μm of average grain size, and 0.08 and 0.10 of deviation coefficient of grain size distribution, respectively, each in which 0.2 mol % of silver bromide was located at the surface of grains) in such amounts that each dye corresponds $2.0\times10^{-4}$ mol to the large size emulsion and $2.5\times10^{-4}$ mol to the small size emulsion, per mol of silver, and then sulfur-sensitized. The thus-prepared emulsion and the above-obtained emulsified dispersion were mixed together and dissolved to give the composition shown below, thereby preparing the first layer coating solution.

Coating solutions for the second to seventh layers were also prepared in the same manner as the first-layer coating solution. As a gelatin hardener for the respective layers, 1-hydroxy-3,5-dichloro-s-triazine sodium salt was used.

As spectral-sensitizing dyes for the respective layers, the following compounds were used:

Blue-sensitive emulsion layer:

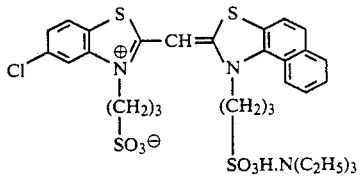

and

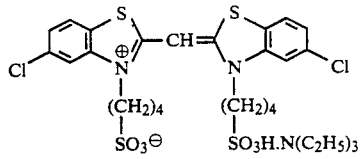

(each $2.0\times10^{-4}$ mol to the large size emulsion and $2.5\times10^{-4}$ mol to the small size emulsion, per mol of silver halide.)

Green-sensitive emulsion layer:

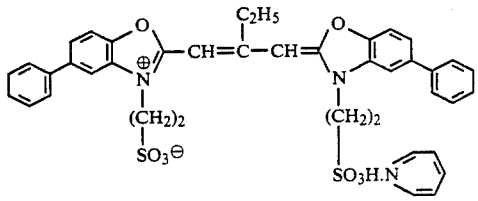

($4.0\times10^{-4}$ mol to the large size emulsion and $5.6\times10^{-4}$ mol to the small size emulsion, per mol of silver halide)

and

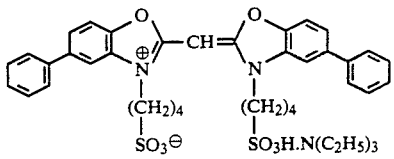

($7.0\times10^{-5}$ mol to the large size emulsion and $1.0\times10^{-5}$ mol to the small size emulsion, per mol of silver halide)

Red-sensitive emulsion layer:

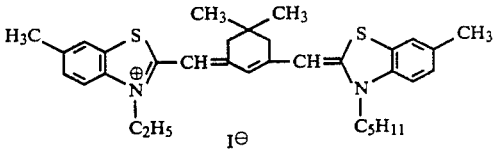

($0.9\times10^{-4}$ mol to the large size emulsion and $1.1\times10^{-4}$ mol to the small size emulsion, per mol of silver halide)

To the red-sensitive emulsion layer, the following compound was added in an amount of $2.6\times10^{-3}$ mol per mol of silver halide:

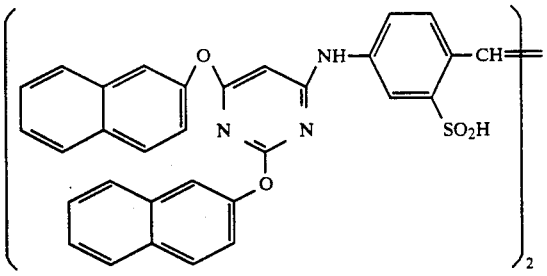

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.0\times10^{-4}$ mol, and $2.5\times10^{-4}$ mol, per mol of silver halide, respectively.

The dyes shown below were added to the emulsion layers for prevention of irradiation.

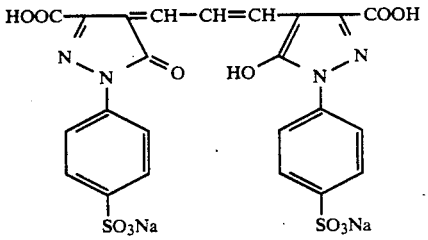

and

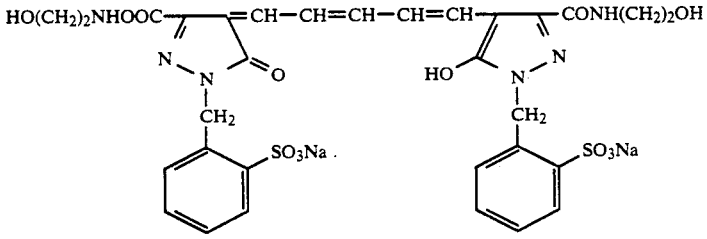

Composition of Layers

The composition of each layer is shown below. The figures represent coating amount (g/m$^2$). The coating amount of each silver halide emulsion is given in terms of silver.

| | |
|---|---|
| Supporting Base | |
| Paper laminated on both sides with polyethylene (a white pigment, $TiO_2$, and a bluish dye, ultramarine, were included in the first layer side of the polyethylene-laminated film) | |
| First Layer (Blue-sensitive emulsion layer): | |
| The above-described silver chlorobromide emulsion | 0.30 |
| Gelatin | 3.60 |
| Yellow coupler (ExY) | 0.82 |
| Image-dye stabilizer (Cpd-1) | 0.19 |
| Solvent (Solv-1) | 0.35 |
| Image-dye stabilizer (Cpd-7) | 0.06 |
| Second Layer (Color-mix preventing layer): | |
| Gelatin | 2.00 |
| Color mix inhibitor (Cpd-5) | 0.08 |

-continued

| | |
|---|---|
| Solvent (Solv-1) | 0.16 |
| Solvent (Solv-4) | 0.08 |
| Third Layer (Green-sensitive emulsion layer): | |
| Silver chlorobromide emulsions (cubic grains, 1:3 (Ag mol ratio) blend of grains having 0.55 μm and 0.39 μm of average grain size, and 0.10 and 0.08 of deviation coefficient of grain size distribution, respectively, each in which 0.8 mol % of AgBr was located at the surface of grains) | 0.12 |
| Gelatin | 2.40 |
| Magenta coupler (ExM) | 0.20 |
| Image-dye stabilizer (Cpd-2) | 0.03 |
| Image-dye stabilizer (Cpd-3) | 0.15 |
| Image-dye stabilizer (Cpd-4) | 0.02 |
| Image-dye stabilizer (Cpd-9) | 0.02 |
| Solvent (Solv-2) | 0.40 |
| Fourth Layer (Ultraviolet ray absorbing layer): | |
| Gelatin | 3.00 |
| Ultraviolet absorber (UV-1) | 0.47 |
| Color-mix inhibitor (Cpd-5) | 0.05 |
| Solvent (Solv-5) | 0.24 |
| Fifth Layer (Red-sensitive emulsion layer): | |
| Silver chlorobromide emulsions (cubic grains, 1:4 (Ag mol ratio) blend of grains having 0.58 μm and 0.45 μm of average grain size, and 0.09 and 0.11 of deviation coefficient of grain size distribution, respectively, each in which 0.6 mol % of AgBr was located at the surface of grains) | 0.23 |
| Gelatin | 3.00 |
| Cyan coupler (ExC) | 0.32 |
| Image-dye stabilizer (Cpd-6) | 0.17 |
| Image-dye stabilizer (Cpd-7) | 0.40 |
| Image-dye stabilizer (Cpd-8) | 0.04 |
| Solvent (Solv-6) | 0.15 |
| Sixth layer (Ultraviolet ray absorbing layer): | |
| Gelatin | 1.50 |
| Ultraviolet absorber (UV-1) | 0.16 |
| Color-mix inhibitor (Cpd-5) | 0.02 |
| Solvent (Solv-5) | 0.08 |
| Seventh layer (Protective layer): | |
| Gelatin | 3.00 |
| Acryl-modified copolymer of polyvinyl alcohol (modification degree: 17%) | 0.17 |
| Liquid paraffin | 0.03 |

Compounds used are as follows:

(ExY) Yellow coupler

-continued
Mixture (1:1 in molor ratio) of
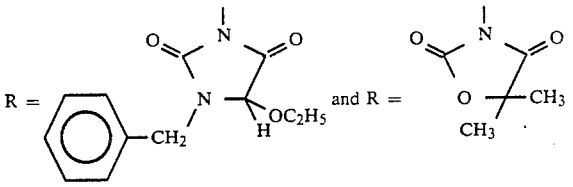
of the following formula
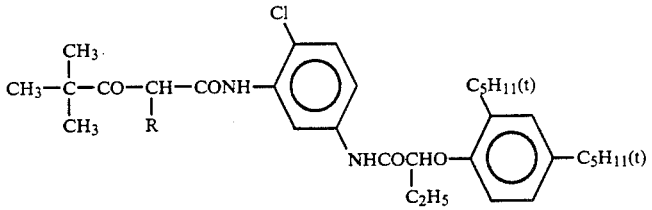
(ExM) Magenta coupler
Mixture (1:1 in molar ratio) of
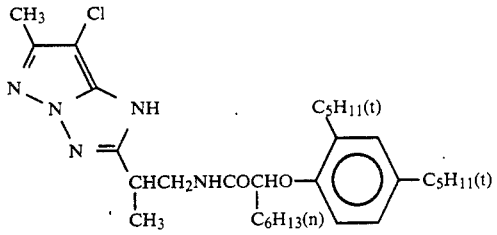
and
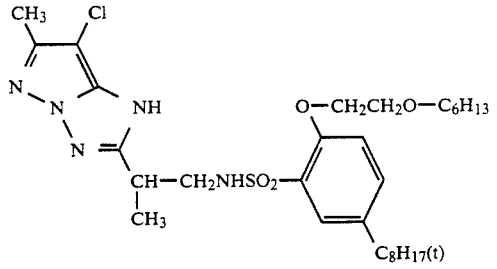
(ExC) Cyan coupler
Mixture (2:4:4 in weight ratio) of
R = $C_2H_5$ and $C_4H_9$ of
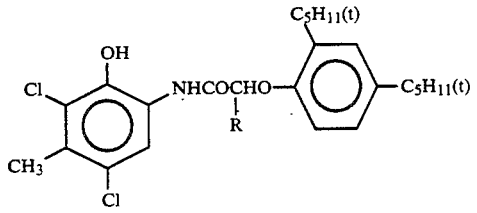
and
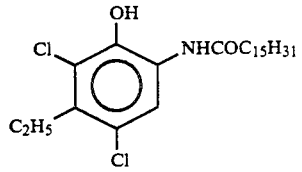
(Cpd-1) Image-dye stabilizer -continued
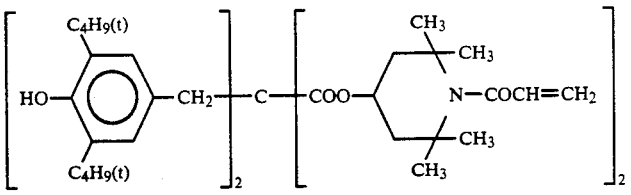
(Cpd-2) Image-dye stabilizer
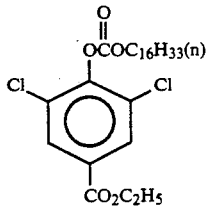
(Cpd-3) Image-dye stabilizer
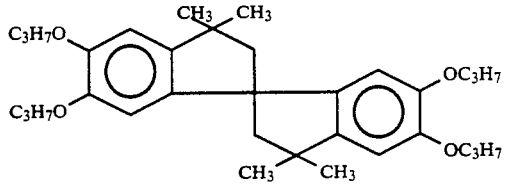
(Cpd-4) Image-dye stabilizer
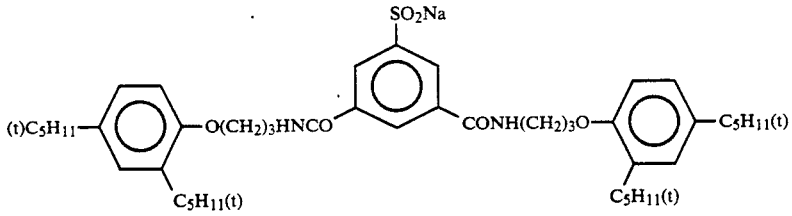
(Cpd-6) Color-mix inhibitor
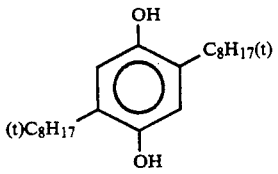
(Cpd-5) Image-dye stabilizer
Mixture (2:4:4 in weight ratio) of
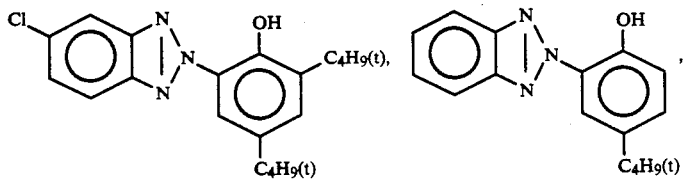
and -continued
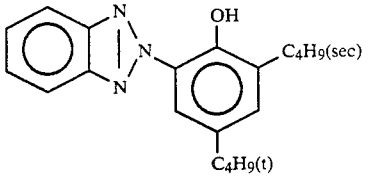
(Cpd-7) Image-dye stabilizer
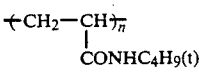
Average molecular weight: 60,000
(Cpd-8) Image-dye stabilizer
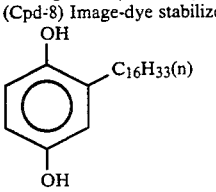
(Cpd-9) Image-dye stabilizer
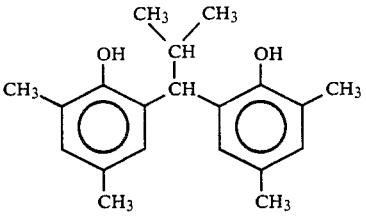
(UV-1) Ultraviolet ray absorber
Mixture (4:2:4 in weight ratio) of
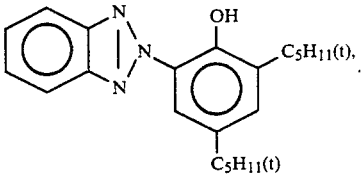
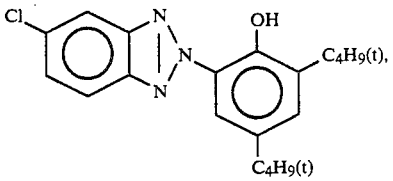
and
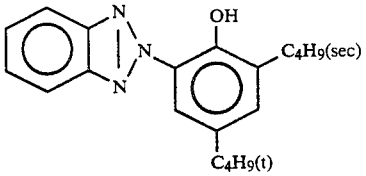
(Solv-1) Solvent
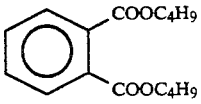
(Solv-2) Solvent
Mixture (2:1 in volume ratio) of
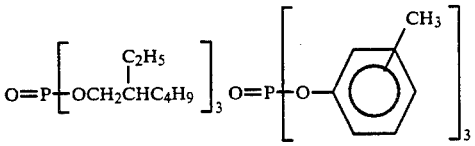

-continued (Solv-4) Solvent

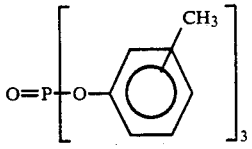

(Solv-5) Solvent

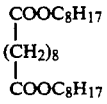

(Solv-6) Solvent

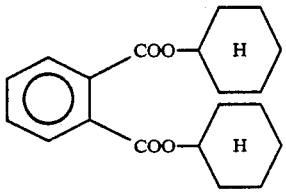

The thus-prepared multilayer photographic material was designated Sample A.

Samples B to F were prepared in the same manner as Sample A, except that coating amounts of gelatin in first layer to seventh layer were changed to as shown in the following table, respectively.

| | A | B | C | D | E | F |
|---|---|---|---|---|---|---|
| 1st layer (g/m$^2$) | 3.60 | 3.30 | 2.90 | 2.50 | 1.90 | 1.50 |
| 2nd layer | 2.00 | 2.00 | 1.50 | 1.50 | 1.00 | 0.80 |
| 3rd layer | 2.40 | 2.30 | 2.20 | 1.70 | 1.20 | 1.00 |
| 4th layer | 3.00 | 2.70 | 2.58 | 2.00 | 1.58 | 1.30 |
| 5th layer | 3.00 | 2.80 | 2.34 | 1.80 | 1.34 | 1.10 |
| 6th layer | 1.50 | 1.50 | 1.53 | 1.00 | 0.53 | 0.30 |
| 7th layer | 3.00 | 2.80 | 2.33 | 1.80 | 1.33 | 1.10 |
| Thickness (μm)* | 20 | 17 | 15 | 13 | 10 | 8 |

Note:
*thickness of dry layers

Samples A to F above-obtained each were exposed to light through an wedge at 250 CMS and processed by the following processing process.

| Process | Time | Temperature |
|---|---|---|
| Color-developing | 45 sec. | 38° C. |
| Bleach-fixing | 45 sec. | 35° C. |
| Rinsing 1 | 20 sec. | 30–38° C. |
| Rinsing 2 | 20 sec. | 30–38° C. |
| Rinsing 3 | 20 sec. | 30–38° C. |
| Drying | 40 sec. | 60–80° C. |

Compositions of each processing solution are shown below. Preservative and additive of color developer were changed as shown in Table 1. Each color developer was used immediately after preparation and after allowed to keep 30 days at 38° C. (opened surface ratio:0.02 cm$^{-1}$).

| | |
|---|---|
| Color developer | |
| Water | 800 ml |
| Ethylenediamine-N,N,N',N,-tetramethylene phosphonic acid | 1.5 g |
| Preservative (see table 1) | 0.05 mol |
| Triethanolamine | 8.0 g |
| Sodium chloride | 3.0 g |
| Potassium carbonate | 25 g |
| N-ethyl-N-(β-methanesulfonamidoethyl)-3-methyl-4-aminoaniline sulfonate | 5.0 g |
| Potassium bromide | 0.015 g |
| Fluorescent brightening agent (UVITEX CK, made by Ciba Gaigy Co.) | 2.0 g |
| Compound of formula (W-1) (see table 1) | 0.3 g |
| Water to make | 1000 ml |
| pH (25° C.) | 10.10 |
| Bleach-fixing solution | |
| Water | 400 ml |
| Ammonium thiosulfate (70%) | 100 ml |
| Sodium sulfite | 18 g |
| Iron (III) ammonium ethylenediamine-tetraacetic acide dihydrate | 55 g |
| Disodium ethylenediaminetetraacetate | 5 g |
| Ammonium chloride | 40 g |
| Glacial acetic acid | 8 g |
| Water to make | 1000 ml |
| pH (25° C.) | 5.50 |
| Rinsing solution | |
| Ion-exchanged water (Calcium and magnesium each were contained 3 ppm or below) | |

Minimum densities (Dmin) after processing using color developer immediately after preparation and after lapse of time were determined by Macbeth densitometer. Changes of density are shown in Table 1.

TABLE 1

| No. | Sample | Color developer | | ΔDmin | | | Remarks |
|---|---|---|---|---|---|---|---|
| | | Preservative | Surfactant | B | G | R | |
| 1 | E | Monoethylhydroxylamine | — | +0.12 | +0.10 | +0.08 | Comparative Example |
| 2 | B | Diethylhydroxylamine | — | +0.10 | +0.08 | +0.06 | " |
| 3 | E | " | — | +0.10 | +0.08 | +0.06 | " |

TABLE 1-continued

| No. | Sample | Color developer Preservative | Color developer Surfactant | ΔDmin B | ΔDmin G | ΔDmin R | Remarks |
|---|---|---|---|---|---|---|---|
| 4 | B | " | W-7 | +0.10 | +0.08 | +0.06 | " |
| 5 | E | " | " | +0.10 | +0.08 | +0.06 | " |
| 6 | E | " | W-23 | +0.10 | +0.08 | +0.06 | " |
| 7 | B | (2) | — | +0.07 | +0.05 | +0.03 | " |
| 8 | E | (7) | — | +0.07 | +0.05 | +0.03 | " |
| 9 | A | (2) | W-8 | +0.06 | +0.04 | +0.04 | " |
| 10 | B | " | " | +0.06 | +0.04 | +0.02 | " |
| 11 | C | " | " | +0.06 | +0.04 | +0.02 | " |
| 12 | D | " | " | +0.02 | +0.01 | 0 | This Invention |
| 13 | E | " | " | +0.01 | 0 | 0 | " |
| 14 | F | " | W-23 | +0.01 | 0 | 0 | " |
| 15 | A | (7) | " | +0.07 | +0.05 | +0.03 | Comparative Example |
| 16 | B | " | " | +0.06 | +0.04 | +0.02 | " |
| 17 | C | " | " | +0.06 | +0.04 | +0.02 | " |
| 18 | D | " | " | +0.02 | +0.01 | 0 | This Invention |
| 19 | E | " | " | +0.01 | 0 | 0 | " |
| 20 | F | " | " | +0.01 | 0 | 0 | " |

Even when the compound of formula (W-1) or (I) is used, if the thickness of the coatings exceeds 15 μm, the increase in Dmin is great (Nos. 8, 9, 10, 14, 15, and 16), while even if the thickness of the coatings is 15 μm or below, the effect cannot be obtained when the compound of the present invention is not present. In the present invention (Nos. 6 and 7), good photographic performance wherein the increase of color stain Dmin is small, that is, the white background stain is little, can be obtained even when the color developer deteriorates.

As could be understood from Nos. 2 and 3 or Nos. 4 and 5, in the case of conventional diethylene-hydroxylamine, even when the thickness of the coatings is reduced, the color stain cannot be made better, while when the compound of the present invention is used, the color stains can be made much better by reducing the thickness of the coatings.

EXAMPLE 2

When compound (2) of No. 12 in Example 1 was changed to compound (1), (3), (11), (14), (20), (23), (27), (30), (42), or (52), similar good result was obtained.

EXAMPLE 3

When surface active agent W-8 No. 12 in Example 1 was changed to W-3, W-7, W-11, W-15, W-21, W-23, or W-28, similar good result was obtained.

EXAMPLE 4

Samples 4-A, 4-B, 4-C, 4-D, and 4-E were prepared in the same manner as sample E in Example 1, except that magenta coupler was changed to the following compound in equimolar amount, respectively. The thus-prepared samples were processed by same processing solutions No. 4, 7, and 12, respectively, and change of Dmin of magenta color ($\Delta D_G$min) was measured.

Results are shown in Table 2.

4-A: same as sample E in Example 1
4-B: M-6
4-C: M-24

-continued

4-D:

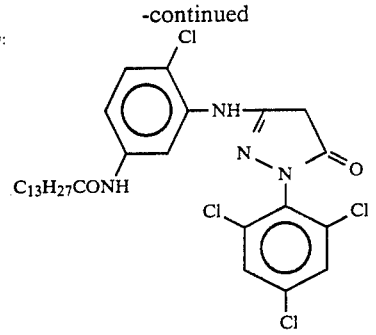

4-E:

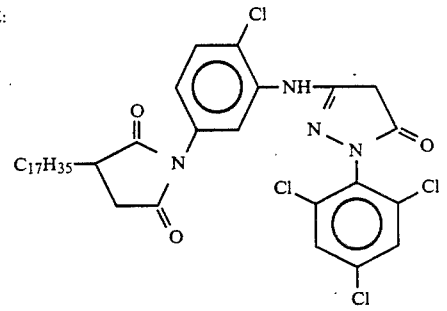

TABLE 2

| Processing solution | Δ $D_G$min 4-A | 4-B | 4-C | 4-D | 4-E | Remarks |
|---|---|---|---|---|---|---|
| NO. 4 | +0.08 | +0.08 | +0.09 | +0.08 | +0.07 | Comparative Example |
| No. 7 | +0.05 | +0.05 | +0.05 | +0.05 | +0.05 | Comparative Example |
| No. 12 | 0 | 0 | 0 | +0.02 | +0.02 | This Invention |

According to the present invention the increase of fogging Dmin was a little, and particularly the effect was remarkable in Samples 4-A, 4-B, and 4-C in which preferable magenta couplers represented by formulae (M-I) and (M-II) were used.

EXAMPLE 5

A multilayer color photographic paper was prepared by coating layers as hereinbelow described on a paper laminated on both sides with polyethylene. Coating solutions were prepared as follows:

Preparation of the first-layer coating solution

To a mixture of 60.0 g of yellow coupler (ExY) and 28.0 g of discoloration inhibitor (Cpd-1), 150 ml of ethyl acetate, 1.0 ml of solvent (Solv-3) and 3.0 ml of solvent (Solv-4) were added and dissolved. The resulting solution was added to 450 ml of 10% aqueous gelatin solution, and then the mixture was dispersed by a supersonic homogenizer. The resulting dispersion was mixed with and dissolved in 420 g of silver chloro-bromide emulsion (silver bromide:0.7 mol%) containing a blue-sensitive sensitizing dye, described below, to prepare the first-layer coasting solution.

Coating solutions for the second to seventh layers were also prepared in the same manner as in the first layer coating solution. As a gelatin hardener for the respective layers, 1,2-bis(vinylsulfonyl)ethane was used.

As spectral sensitizers for the respective layers, the following compounds were used:

Blue-sensitive emulsion layer:

Anhydro-5,5'-dichloro-3,3'-disulfoethylthia-cyanine hydroxide

Green-sensitive emulsion layer:

Anhydro-9-ethyl-5,5'-diphenyl-3,3'-disulfoethylox-acarbocyanine hydroxide

Red-sensitive emulsion layer:

3,3'-Diethyl-5-methoxy-9,9'-(2,2'-dimethyl-1,3-propano)thiacarbocyanine iodide

As a stabilizer for the respective emulsion layer, a mixture (7:2:1 in molar ratio) of the following compounds was used:

1-(2-Acetoaminophenyl)-5-mercaptotetrazole,
1-Phenyl-5-mercaptotetrazole, and
1-(p-Methoxyphenyl)-5-mercaptotetrazole As irradiation preventing dyes the following compounds were used:

[3-Carboxy-5-hydroxy-4-(3-(3-carboxy-5-oxo-1-(2,5-sulfonatophenyl)-2-pyrazoline-4-iridene)-1-propenyl)-1-pyrazolyl]benzene-2,5-disulfonatedisodium salt, N,N'-(4,8-Dihydroxy-9,10-dioxo-3,7-disulfonatoanthracene-1,5-diyl)bis(aminomethanesulfonate)tetrasodium salt, and

[3-Cyano-5-hydroxy-4-(3-(3-cyano-5-oxo-1-(4-sulfonatophenyl)-2-pyrazoline-4-iridene)-1-pentanyl)-1-pyrazolyl]benzene-4-sulfonato-sodium salt Composition of layers The composition of each layer is shown below. The figures represent coating amounts (g/m$^2$). The coating amounts of each silver halide emulsion is represented in terms of silver.

| | |
|---|---|
| Base | |
| Paper support laminated on both sides with polyethylene film and subjected to surface corona discharge treatment | |
| First Layer (Blue-sensitive emulsion layer): | |
| The above-described silver chlorobromide emulsion (AgBr: 0.7 mol %, cubic grain, average grain size: 0.9 μm) | 0.29 |
| Gelatin | 1.80 |
| Yellow coupler (ExY) | 0.60 |
| Discoloration inhibitor (Cpd-1) | 0.28 |
| Solvent (Solv-3) | 0.01 |
| Solvent (Solv-4) | 0.03 |
| Second Layer (Color-mix preventing layer): | |
| Gelatin | 0.80 |

-continued

| | |
|---|---|
| Color-mix inhibitor (Cpd-2) | 0.055 |
| Solvent (Solv-1) | 0.03 |
| Solvent (Solv-2) | 0.15 |
| Third Layer (Green-sensitive emulsion layer): | |
| The above-described silver chlorobromide emulsion (AgBr: 0.7 mol %, cubic grain, average grain size: 0.45 μm) | 0.18 |
| Gelatin | 1.86 |
| Magenta coupler (ExM) | 0.27 |
| Discoloration inhibitor (Cpd-3) | 0.17 |
| Discoloration inhibitor (Cpd-4) | 0.10 |
| Solvent (Solv-1) | 0.20 |
| Solvent (Solv-2) | 0.03 |
| Fourth Layer (Color-mix preventing layer): | |
| Gelatin | 1.70 |
| Color-mix inhibitor (Cpd-2) | 0.065 |
| Ultraviolet absorber (UV-1) | 0.45 |
| Ultraviolet absorber (UV-2) | 0.23 |
| Solvent (Solv-1) | 0.05 |
| Solvent (Solv-2) | 0.05 |
| Fifth Layer (Red-sensitive emulsion layer): | |
| The above-described silver chlorobromide emulsion (AgBr: 4 mol %, cubic grain, average grain size: 0.5 μm) | 0.21 |
| Gelatin | 1.80 |
| Cyan coupler (ExC-1) | 0.26 |
| Cyan coupler (ExC-2) | 0.12 |
| Discoloration inhibitor (Cpd-1) | 0.20 |
| Solvent (Solv-1) | 0.16 |
| Solvent (Solv-2) | 0.09 |
| Color-forming accelerator (Cpd-5) | 0.15 |
| Sixth layer (Ultraviolet ray absorbing layer): | |
| Gelatin | 0.70 |
| Ultraviolet absorber (UV-1) | 0.26 |
| Ultraviolet absorber (UV-2) | 0.07 |
| Solvent (Solv-1) | 0.30 |
| Solvent (Solv-2) | 0.09 |
| Seventh layer (Protective layer): | |
| Gelatin | 1.07 |

Compound used are as follows:

(ExY) Yellow coupler
α-Pivalyl-α-(3-benzyl-1-hidantoinyl)-2-chloro-5[β-(dodecylsulfonyl)butyramido]acetoanilide (ExM) Magenta coupler ((A-3)-5)
7-Chloro-6-isopropyl-3-{3-[2-butoxy-5-tert-octyl)-benzenesulfonyl]propyl}-1H-pyrazolo[5,1-c]-1,2,4-triazole (ExC-1)Cyan coupler
2-Pentafluorobenzamido-4-chloro-5[2-(2,4-di-tert-amylphenoxy)-3-methylbutyramidophenol (ExC-2) Cyan coupler
2,4-Dichloro-3-methyl-6-[α-(2,4-di-tert-amylphenoxy)butyramido]phenol

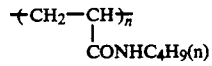

Average molecular weight: 80,000

(Cpd-2) Color-mix inhibitor
2,5-Di-tert-octylhydroquinone (Cpd-3) Discoloration inhibitor
7,7'-dihydroxy-4,4,4',4'-tetramethyl-2,2'-spirocumarone (Cpd-4) Discoloration inhibitor
N-(4-dodecyloxyphenyl)-morpholine (Cpd)-5) Color-forming accelerator
p-(p-Toluenesulfonamido)phenyl-dodecane (Solv-1) Solvent
Di(2-ethylhexyl)phthalate (Solv-2) Solvent Dibutylphthalate (Solv-3) Solvent Di(i-nonyl)phthalate (Solv-4) Solvent N,N-diethylcarbonamido-methoxy-2,4-di-t-amylbenzene (UV-1) Ultraviolet absorber 2-(2-Hydroxy-3,5-di-tert-amylphenyl)benzotriazole (UV-2) Ultraviolet absorber 2-(2-Hydroxy-3,5-di-tert-butylphenyl)benzotriazole The thus-prepared samples were subjected to an imagewise exposure to light and to a continuous processing through the following steps by using a paper processor until a volume of color developer twice that of a tank had been replenished. Color developers used in the continuous processing (running test) were 5-A, 5-B, and 5-C, as shown below, respectively.

| Processing steps | Temperature | Time | Replenisher Amount* | Tank Volume |
|---|---|---|---|---|
| Color developing | 38° C. | 45 sec. | 70 ml | 4 l |
| Bleach-fixing | 38° C. | 45 sec. | 61 ml | 4 l |
| Water washing 1 | 30–37° C. | 30 sec. | — | 2 l |
| Water washing 2 | 30–37° C. | 30 sec. | — | 2 l |
| Water washing 3 | 30–37° C. | 30 sec. | 364 ml | 2 l |
| Drying | 70–85° C. | 60 sec. | | |

Note:

*Replenisher amount per 1 $m^2$ of the photographic material

The washing solutions were used in a counter-current flowing system from the tank of washing 3 toward the tank of washing 1. Solution of washing 1 in an amount of 122 ml per 1 $m^2$ of photographic material was replenished to the bleach-fixing bath.

The compositions of the respective processing solution were as follows:

| | Tank solution | Replenisher |
|---|---|---|
| Color developer | | |
| Water | 800 ml | 800 ml |
| Ethylenediamine-N,N,N',N'-tetramethylene phosphonic acid | 3.0 g | 3.0 g |
| Diethylhydroxylamine | 0.05 mol | 0.08 mol |
| Sodium chloride | 4.5 g | — |
| Potassium bromide | 0.03 g | — |
| Potassium carbonate | 25 g | 25 g |
| N-ethyl-N-(β-methanesulfonamidoethyl)-3-methyl-4-aminoaniline sulfate | 5.0 g | 10.0 g |
| Triethanolamine | 8.0 g | 8.0 g |
| Fluorescent brightening agent (4,4-diaminostilbene series) | 1.0 g | 2.5 g |
| W-23 | 0.03 g | 0.04 g |
| Water to make | 1000 ml | 1000 ml |
| pH (25° C.) | 10.05 | 10.80 |
| Bleach-fixing solution | | |
| (Tank solution) | | |
| Water | | 400 ml |
| Ammonium thiosulfate (70%) | | 100 ml |
| Sodium sulfite | | 38 g |
| Iron (III) ammonium ethylenediaminetetraacetate | | 55 g |
| Disodium ethylenediaminetetraacetate | | 5 g |
| Glacial acetic acid | | 9 g |
| Water to make | | 1000 ml |
| pH (25° C.) | | 5.40 |
| (Replenisher) | | |
| Solution of 2.5 times as concentrated as tank solution | | |
| Washing solution | | |
| (both tank solution and replenisher) | | |
| Ion-exchanged water (calcium and magnesium each were contained in a concentration of 3 ppm or below) | | |

The continuous processing was carried out by adding distilled water corresponding amount of evaporated to each of color developer, bleach-fixing solution, and washing solution for correction of condensation due to evaporation.

Color developer 5-B

Same as 5-A except that diethylhydroxylamine was changed to compound (1)

Color developer 5-C

Same as 5-A except that diethylhydroxylamine was changed to compound (7)

Using the above-obtained 3 kinds of running solutions, Samples A to F prepared in Example 1 were subjected to running test, and the changes of Dmin during the running test were determined.

Results are shown in Table 3.

TABLE 3

| | | Change of Minimum Density (ΔDmin) | | | | | | | | |
|---|---|---|---|---|---|---|---|---|---|---|
| | | Developer 5-A | | | Developer 5-B | | | Developer 5-C | | |
| No. | Sample | B | G | R | B | G | R | B | G | R |
| 1 | A | +0.05 | +0.03 | +0.01 | +0.03 | +0.02 | +0.01 | +0.03 | +0.01 | +0.01 |
| 2 | B | +0.04 | +0.03 | +0.01 | +0.03 | +0.02 | +0.01 | +0.03 | +0.01 | +0.01 |
| 3 | C | +0.05 | +0.03 | +0.01 | +0.03 | +0.02 | +0.01 | +0.03 | +0.01 | +0.01 |
| 4 | D | +0.05 | +0.03 | +0.01 | | | | | | |
| 5 | E | +0.05 | +0.03 | +0.01 | +0.01 | 0 | 0 | +0.01 | 0 | 0 |
| 6 | F | +0.05 | +0.03 | +0.01 | 0 | 0 | 0 | 0 | 0 | 0 |
| | | | | | 0 | 0 | 0 | 0 | 0 | 0 |

Note:

[ ] designates results of this invention

When diethylhydroxylamine and the compound represented by formula (W-1) are used in combination, the change of Dmin, in particular, the change of Dmin of BL could not be suppressed even if the thickness of the coatings is reduced, while when the compound represented by formula (W-1) is combined with the compound represented by formula (I), the color stains can be suppressed conspicuously.

Having described our invention as related to the embodiment, it is our intention that the invention be not limited by any of the details of the description, unless otherwise specified, but rather be construed broadly within its spirit and scope as set out in the accompanying claims.

What we claim is:

1. A method for processing a silver halide color photographic material, which comprises processing an image-wise exposed silver halide color photographic material which comprises at least one high silver chloride emulsion layer comprising at least 90 mol % silver chloride, wherein the thickness of dried coating of the photographic material is 15 μm or less, with a color developer containing an aromatic primary amine color-developing agent, at least one of anionic surface-active agents in an amount of 0.05 to 3 g/l of the developer, represented by the following formula (W-I):

$$R—X \qquad \text{Formula (W-I)}$$

wherein R represents a substituted or unsubstituted alkyl, cycloalkyl, alenyl, alkynyl, aryl, or heterocyclic group having 8 to 30 carbon atoms, and X represents —COOM, —$SO_3M$, —$OSO_3M$, —OP-$(OM)_2$, or

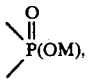

in which M represents a hydrogen atom, lithium, potassium, sodium, or ammonium, and at least one of compounds represented by the following formula (I) in an amount of 0.1 to 50 g/l of the developer:

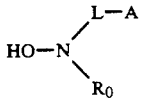

wherein L represents an alkylene group, A represents a carboxyl group, a sulfo group, a phosphono group, a phosphinic acid residue, a hydroxyl group, an amino group, or an ammonia group, and $R_0$ represents an alkyl group having from 1 to 10 carbon atoms, by using an automatic processor, wherein the opened surface ratio of color developing solution in the processing tank is 0.1 $cm^{-1}$ or below, and then delivering the photographic material.

2. The method as claimed in claim 1, wherein R in formula (W-I) represents an alkyl, alkenyl, or aryl group having 8 to 30 carbon atoms.

3. The method as claimed in claim 1, wherein the content of the anionic surface-active agent represented by formula (W-I) in the color developer is 0.01 to 10 g/l.

4. The method as claimed in claim 1, wherein L in formula (I) represents a straight-chain or branched-chain alkylene group having 1 to 10 carbon atoms.

5. The method as claimed in claim 1, wherein $R_0$ in formula (I) represents an optionally substituted straight-chain or branched-chain alkyl group having 1 to 10 carbon atoms.

6. The method as claimed in claim 1, wherein L and $R_0$ in formula (I) bond together to form a ring.

7. The method as claimed in claim 1, wherein the pH of the color developer is in the range of 9 to 12.

8. The method as claimed in claim 1, wherein the processing temperature with the color developer is 20 to 50° C.

9. The method as claimed in claim 1, wherein the processing time with the color developer is 20 sec. to 5 min.

10. The method as claimed in claim 1, wherein the thickness of dried coating of silver halide color photographic material is 6 to 13 μm.

11. The method as claimed in claim 1, wherein the thickness of dried coatings of silver halide color photographic material is 6 to 10 μm.

12. The method as claimed in claim 1, wherein the color developer has a benzyl alcohol content of 2 ml or less per liter of the developer.

* * * * *